United States Patent [19]

Sugata et al.

[11] Patent Number: 4,898,798

[45] Date of Patent: Feb. 6, 1990

[54] PHOTOSENSITIVE MEMBER HAVING A LIGHT RECEIVING LAYER COMPRISING A CARBONIC FILM FOR USE IN ELECTROPHOTOGRAPHY

[75] Inventors: Masao Sugata, Yokohama; Tohru Den, Atsugi; Susumu Ito; Keiji Hirabayashi, both of Tokyo; Keiko Ikoma, Yokohama; Noriko Kurihara, Kawasaki; Kuniji Osabe, Tama; Tatsuo Takeuchi, Kawasaki; Hiroshi Satomura, Hatogaya; Yoshihiro Oguchi, Yokohama; Akio Maruyama, Tokyo; Keishi Saito, Nabari, all of Japan

[73] Assignee: Canon Kabushiki Kaisha, Tokyo, Japan

[21] Appl. No.: 101,948

[22] Filed: Sep. 25, 1987

[30] Foreign Application Priority Data

| | | | |
|---|---|---|---|
| Sep. 26, 1986 | [JP] | Japan | 61-227302 |
| Sep. 26, 1986 | [JP] | Japan | 61-227303 |
| Sep. 26, 1986 | [JP] | Japan | 61-227304 |
| Sep. 26, 1986 | [JP] | Japan | 61-227305 |
| Sep. 26, 1986 | [JP] | Japan | 61-227306 |
| Sep. 26, 1986 | [JP] | Japan | 61-227310 |
| Sep. 26, 1986 | [JP] | Japan | 61-227311 |
| Sep. 4, 1987 | [JP] | Japan | 62-220491 |

[51] Int. Cl.[4] ..... G03G 5/10

[52] U.S. Cl. ..... 430/58; 430/65; 430/66

[58] Field of Search ..... 430/85, 94, 66, 57, 430/58, 65

[56] References Cited

U.S. PATENT DOCUMENTS

| | | | |
|---|---|---|---|
| 4,634,648 | 1/1987 | Jansen et al. | 430/84 |
| 4,673,589 | 6/1987 | Standley | 427/41 |
| 4,675,265 | 6/1987 | Kazama et al. | 430/66 |

*Primary Examiner*—John L. Goodrow

*Attorney, Agent, or Firm*—Fitzpatrick, Cella, Harper & Scinto

[57] ABSTRACT

An improved photosensitive member for use in electrophotography which comprises a substrate and a light receiving layer having a charge carrier generation layer and a charge carrier transportation layer composed of a carbonic film the nucleus of which matrix being carbon atom, which contains 40 atomic % or less of hydrogen atom and which possesses an optical band gap of 1.5 eV or more and an electric conductivity of $10^{-11}$ $\Omega^{-1}cm^{-1}$ or less.

It is always and substantially stable regardless of the changes in use environments and it enables to make highly resolved images with a clear half-tone which are highly dense and quality at high speed.

19 Claims, 5 Drawing Sheets

PHOTOSENSITIVE MEMBER HAVING A LIGHT RECEIVING LAYER COMPRISING A CARBONIC FILM FOR USE IN ELECTROPHOTOGRAPHY

FIELD OF THE INVENTION

This invention relates to an improved photosensitive member for use in electrophotography (hereinafter, the term "photosensitive member for use in electrophotography" being referred to as the term "electrophotographic photosensitive member"). More particularly, it relates to an improved electrophotographic photosensitive member having a light receiving layer comprising a charge carrier generation layer and a charge carrier transportation layer constituted with a carbonic film and which is substantially stable regardless of the changes in environment use and which enables one to make a highly resolved image with a clear half-tone at high speed.

In this invention, the term "carbonic film" means such a film composed of a carbonic structural material containing 65 atomic % or more of carbon atom and the nucleus of which matrix being carbon atoms. And otherwise defined, the term "standard condition" means the atmospheric condition comprising atmospheric pressure, 20° C. for temperature and 50% for humidity.

BACKGROUND OF THE INVENTION

There have been proposed a number of electrophotographic photosensitive members having a photoconductive layer composed of an inorganic material such as amorphous selenium (A-Se), CdS, ZnO and amorphous silicon (A-Si) or an organic material.

However, for any of the known electrophotographic photosensitive members, there are still unresolved problems.

For instance, as for the known electrophotographic photosensitive member having a A-Se photoconductive layer, there is a limit for its use because its spectral sensitivity inclines toward the short wavelength side of visible region. In order to solve this problem, there is a proposal of incorporating Te or As into said A-Se photoconductive layer. For those electrophotographic photosensitive members having such A-Se series photoconductive layer containing Te or As, there can be recognized an improvement in the foregoing problem relating to the spectral sensitivity. However, they are still accompanied with various problems such as increase of a light fatigue, reduction of a charge-retentivity under a high temperature atmospheric condition, increase of a residual potential under a low temperature atmospheric condition, etc. which result in deterioration of the quality of the resulting image and also lack of stability upon repeated use. Other than these, they have been accompanied by other problems in that the hardness of any of the foregoing photoconductive layers is relatively low, and because of this, especially in the case where the surface of said layer is not protected, when it is engaged repeatedly in the cleaning process in a high speed electrophotographic copying machine having an improved blade cleaning system, its surface becomes easily worn away to cause fine particles which eventually intermix in developers, disperse in the copying machine, or otherwise, intermix in the resulting image.

Further in addition, for the foregoing electrophotographic photosensitive member, there is a further problem that because of a low crystallization temperature for selenium (Se), it will be easily crystallized with an incidental heat or with a light energy caused by light irradiation, and in that case, the charge-retentivity becomes reduced accordingly.

There are unresolved problems also for the known electrophotographic photosensitive members having a photoconductive layer composed of ZnO or CdS.

That is, in case of the electrophotographic photosensitive member having a photoconductive layer composed of ZnO, it is necessary to add an appropriate organic pigment in order for said layer to have a sufficient sensitivity against visible light. In addition to this, it is accompanied by a problem in that the photosensitivity is gradually decreased as it is used repeatedly and because of this, it is not suited for repeated use for a long period of time.

And, in case of the electrophotographic photosensitivity member having a photoconductive layer composed of CdS, there is a serious problem since CdS is harmful for a man. Therefore, not only extra attention but also provision of a specific means are necessary to be made in order to prevent occurrence of any environmental problems because of CdS not only in its production but also upon its use.

Now, for the known electrophotographic photosensitive members having a binder series photoconductive layer, there are also unresolved problems. That is, because of the specific requirement that photoconductive particles must be evenly dispersed in a resin binder, there exist a number of parameters to determine electric characteristics, photoconductive characteristics, and physical and chemical characteristics for a photoconductive layer to be prepared. And unless the related parameters are strictly cordinated, an objective desired photoconductive layer is hardly obtained. In addition, because of the uniqueness that the binder series photoconductive layer is a dispersion system and because of this, the layer is entirely of a porous structure, it is very sensitive against changes in the environmental humidity. And in the case where the electrophotographic photosensitive member having such photoconductive layer is used under highly humid environmental atmosphere, there will be easily produced a deterioration in the electric characteristics to thereby make it impossible to obtain a high quality image.

Also in case of other kinds of the known electrophotographic photosensitive members having a photoconductive layer composed of an organic photoconductive material, there still exist various unresolved problems in that the characteristics will be deteriorated during repeated use because of low corona discharging resistance, the cleaning properties are problematic for the reason that an organic polymer as well as toner is used, the surface is easily damaged because of weak mechanical strength and it is difficult to maintain the quality of an image obtained upon repeating use for a long period of time.

Further, for any known electrophotographic photosensitive member as mentioned above, there is another problem caused by occurrence of a friction between a cleaning blade and the photosensitive member which often invites undesirable effects not only in the cleaning properties but also in the electrophotographic properties, especially in case of using it in a high speed electrophotographic copying machine. For instance, it will become difficult to add a sufficient quantity of pressure between the cleaning blade and the photosensitive member in the case where the related coefficient of kinetic friction is large as much as to likely bring about undesirable influences especially on the electrophotographic characteristics.

SUMMARY OF THE INVENTION

This invention is aimed at eliminating the foregoing problems which are found on th conventional electrophotographic photosensitive members and providing an improved electrophotographic photosensitive member which stably and effectively exhibits the functions required for an electrophotographic photosensitive member without accompaniment of the foregoing problems.

It is therefore an object of this invention to provide an improved electrophotographic photosensitive member which is always and substantially stable regardless of the changes in use such as changes in environmental temperature and moisture and which enables one to make highly resolved visible images with a clear halftone, which are highly dense and quality at high speed.

Another object of this invention is to provide an improved electrophotographic photosensitive member which excels in both mechanical strength and heat stability.

A further object of this invention is to provide an improved electrophotographic photosensitive member having an excellent surface lubricity and which is free not only from being mechanically scratched but also from being deposited with foreign matters such as fine particles resulting from corona discharge and other powdery materials resulting from papers to be fed, and which enables one to constantly make stable and satisfactory images even upon repeated use for a long period of time.

A further object of this invention is to provide an improved electrophotographic photosensitive member having a high charge-retentivity and a high photosensitivity which enables one to make satisfactory images even with a small quantity of a charging current and a small quantity of exposure energy.

A further object of this invention is to provide an improved electrophotographic photosensitive member having a specific carbonic light receiving layer of reduced trap level in which a thermal carrier is barely generated and which is free from any changes in quality such as chemical change, deterioration, crystallization and the like even in the case where it is stored under poor environmental conditions for a long period of time.

A further object of this invention is to provide an improved electrophotographic photosensitive member which is desirably suited for high-speed electrophotographic copying system in which it can be smoothly and effectively cleaned without being damaged while maintaining its original image-making function even upon repeated use under poor conditions for a long period of time.

A further object of this invention is to provide an improved electrophotographic photosensitive member which is harmless for and which causes less problems for public pollution even in the case where it is dumped together with daily refuse after use.

A further object of this invention is to provide an inexpensive improved electrophotographic photosensitive member which can be produced using easily obtainable harmless materials as the main raw materials in a simplified apparatus without being provided with a specific means to exhaust harmful materials.

DESCRIPTION OF THE INVENTION

Figure 1:
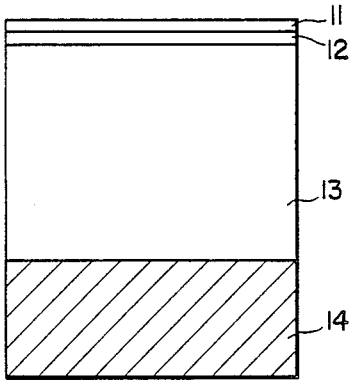
FIG. 1 is a schematic cross-sectional view illustrating a representative embodiment of an electrophotographic photosensitive member according to this invention.

The present inventors have made earnest studies for eliminating the foregoing problems of the conventional electrophotographic photosensitive members and attaining the objects as described above and as a result, have complished this invention.

A typical embodiment of an improved electrophotographic photosensitive member to be provided according to this invention is characterized by a divided-functional electrophotographic photosensitive member having a light receiving layer comprising a charge carrier generation layer (hereinafter, referred to as "carrier generation layer") and a charge carrier transportation layer (hereinafter, referred to as "carrier transportation layer") constituted of a carbonic film composed of a carbonic structural material containing 65 atomic % or more of carbon atom. The nucleus of the material matrix is carbon atoms.

This invention is based on the findings by the present inventors. That is, in the case where said carbonic is used as a constituent layer for the light receiving layer of an electrophotographic photosensitive member, though said carbonic film is highly insulative, once a carrier is injected, the carrier becomes to be effectively transported by the action of an electric field. And, in general, the conduction form of a carrier in an electrophotographic photosensitive member largely depends upon the film forming condition to be employed and the extent of the film forming condition which permits the formation of a desired light receiving layer to bring about a clear band conduction is relatively narrow. Because of this, the resulting electrophotographic photosensitive member often becomes such that gives a transient current waveform which is very likely of a dispersion type.

However, even under such situation, the use of said carbonic film makes the resulting electrophotographic photosensitive member practically applicable.

The carbonic film to be used in this invention has largely different characteristics from any of the hydrocarbon series highly insulative straight chain organic polymers such as polyethylene and also from the low-resistant graphite polycrystal films such as vacuum deposited films of black lead. The foregoing objects of this invention cannot be attained by using these known films.

The reason is that organic polymer containing a large amount of hydrogen atom such as polyethylene as a carrier transportation layer can promote the charge-retentivity but can barely obtain a desired sensitivity against visible region light and near-infrared region light, which is essential for an electrophotographic photosensitive member to be immobilized. A practically usable electrophotographic photosensitive member cannot be obtained even in the case of using the above mentioned graphite polycrystal film, because of its considerably low charge-retentivity.

The carbonic film to be used in this invention may be such that has a polycrystalline phase, an amorphous phase, a phase containing these two structures in a mixed state or other phase selected from those phases containing a single crystalline structure in one of the foregoing phases.

For instance, it may be such that a diamond phase occupies a volume ratio of 50 to 95% and the remainder is occupied by a polycrystalline phase, an amorphous phase or a mixture of them.

The carbonic film to be used in this invention can be identified by other factors than the above such as specific crystalline structure, chemical composition, physical property, etc. as will be below described.

In view of the above, the carbonic film to be used in this invention can be objectively distinguished from any of the known carbon containing films.

By the way, hitherto, there have been various proposals about the use of a layer containing carbon atom as a constituent layer of an electrophotographic photosensitive member as disclosed in Japanese Unexamined Patent Publications Nos. 54(1979)-55439, 55(1980)-4040 (corresponding to U.S. Pat. No. 4,289,822), 56(1981)-121041, 60(1985)-26345, 61(1986)-94048, 61(1986)-94049 and 61(1986)-105551.

However, these publications concern an improvement in the film characteristics of a silicon containing amorphous film or a germanium containing amorphous film by adding carbon atom thereto while maintaining its original functions but do not have any concern over the utilization of functions derived from the nucleus of the matrix for a film to be carbon atom.

In fact, the carbonic film in this invention does contain either silicon atom nor germanium atom. Even in the case where such atom is contained, its amount is of a relatively reduced one.

Further, the film forming conditions disclosed in the above-mentioned publications are directed to formation of the foregoing silicon containing amorphous film or germanium containing amorphous film, and under which conditions, the carbonic film to be used in this invention cannot be obtained.

In a preferred embodiment, the carbonic film to be used in this invention is desired to be such that in addition to the above mentioned conditions, further possesses a particular electric conductivity of $10^{-11}\Omega^{-1}cm^{-1}$ or less.

In a further preferred embodiment, the carbonic film to be used in this invention is desired to be such that in addition to the foregoing conditions, it contains hydrogen atom in an concentration of 40 atomic % or less, and further possesses a particular optical band gap Egopt of 1.5 eV or more.

In a still further preferred embodiment, the carbonic film to be used in this invention is desired to be such that in addition to the foregoing conditions, further possesses a particular gap state density of $5\times10^{17}$ $cm^{-3}$ or less.

In the light receiving layer of the electrophotographic member according to this invention, it is possible for the carrier transportation layer to be placed on the carrier generation layer.

In that case, the carbonic film to constitute the carrier transportation layer is desired further to possess a particular coefficient of kinetic friction of 0.5 or less in view of enhancing the cleaning properties of the electrophotographic photosensitive member.

Here, reference is made to the measuring method of the foregoing coefficient of kinetic friction.

In the measurement of the coefficient of kinetic friction for the carbonic film, it is essential to previously determine the measuring atmospheric conditions since it is difficult for the value to be stably obtained under usual atmospheric conditions and it will be easily varied depending upon the temperature, humidity, etc. under which the measurement is carried out to cause a difference of 2 to 3 folds or sometimes, of about 10 folds on a value obtained.

In this respect, the coefficient of kinetic friction for the carbonic film to constitute the light receiving layer of the electrophotographic photosensitive member according to this invention is determined in accordance with the following equation:

$$\mu = F/P \quad (1)$$

wherein $\mu$ means a coefficient of kinetic friction, F does a power to be applied and P does a vertical load.

Using the equation (1), even though the subject to be measured is of a cylindrical form such as a drum, the coefficient of kinetic friction therefor can be easily measured.

Now, a coefficient of kinetic friction between an electrophotographic photosensitive member and a cleaning blade is an important factor to be considered in the cleaning process of the photosensitive member. And, in the above consideration, there exist other factors to be included which are related to toner being present at that time and its amount, the constituent material of the cleaning blade, etc.

In this connection, the coefficient of kinetic friction in this specification is expressed by that between the surfaces of the electrophotographic photosensitive members. It has been found that there is a satisfactory interrelation between coefficient of kinetic friction and the cleaning properties and that it is practically meaningful.

Figure 6A:
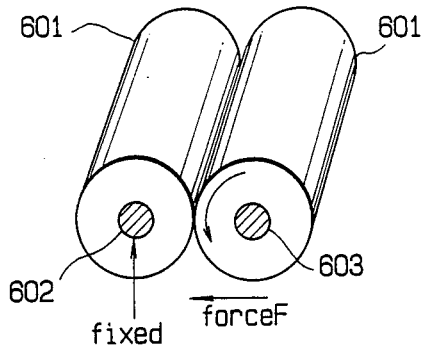
FIGS. 6(A) and 6(B) are schematic explanatory views of a method for measuring a coefficient of kinetic friction.
Figure 6B:
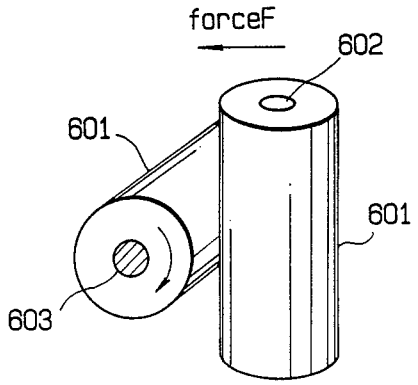

Explanation will be made about the method of measuring the coefficient of kinetic friction while referring to FIGS. 6(A) and 6(B).

Two photosensitive drum members 601 are used in the measurement. One of them is fixed. The other is rotated at a constant speed and then they are pressed by a predetermined force F as shown in FIG. 6. In that case, as the applying force F becomes greater, they receive a corresponding torque and become hard to rotate accordingly.

The above torque is measured and from the resultant figure and the force F applied, a coefficient of kinetic friction for said photosensitive drum member can be determined.

In practice, the coefficient of kinetic friction often depends upon the force F to be applied and also upon the revolution speed of the photosensitive drum member.

In such case, the coefficient of kinetic friction can be determined as follows.

That is, in the case where it depends upon the force F, a force F is applied in different quantities, the value of a coefficient of kinetic friction obtained in each case is plotted on a graph and the value obtained by extraporating the force F to zero is considered as the coefficient of kinetic friction for that member.

In the case where it depends upon the revolution speed, the value of a coefficient of kinetic friction obtained in accordance with each revolution speed as employed is plotted on a graph and the value obtained by extraporating the revolution speed to zero is considered as the coefficient of kinetic friction for that member.

In the case where an extraporation is necessary to be made for the above two things, the point extremely near to zero will sometimes come to the result of measuring an instability and also a coefficient of static friction In this respect, a graph is drawn excluding such point to thereby make said extraporation.

Further, there will occur a difference between a firstly obtained value and a lastly obtained value for the coefficient of kinetic friction when the measurement is repeatedly carried out using the same drum member. In that case, the first value is adopted.

There can be mentioned heat generation caused by the friction between the two members, abrasion of those members, occurrence of fine particles caused by such phenomena, etc., as the cause to invite the foregoing changes in the resulting coefficient of kinetic friction.

Therefore, the measurement of a coefficient of kinetic friction is desired to be made under such conditions that do not cause these phenomena.

By the way, in accordance with the above mentioned procedures, a coefficient of kinetic friction was measured on an OPC photosensitive drum member, an amorphous photosensitive drum member, a selenium photosensitive drum member and a carbonic photosensitive drum member of this invention respectively. As a result, there were obtained a value of 0.6 to 0.7 for each of the OPC drum member and the selenium drum member and a value of 0.7 to 0.8 for the amorphous drum member.

As for the carbonic drum member of which photoconductive layer having more than 65% of a carbon content which was prepared under a high substrate temperature condition, there was obtained a value of 0.05 to 0.2.

From the above result, there can be recognized the fact that the carbonic film in this invention is of a low coefficient of kinetic friction.

This low coefficient of kinetic friction for the carbonic film in this invention can be further lowered by incorporating fluorine atom thereinto.

As above mentioned, the carbonic film to constitute the carrier transportation layer of the electrophotographic photosensitive member according to this invention is desired to possess a particular gap state density of $5\times10^{17}cm^{-3}$ or less.

The measurement of this gapstate density for the carbonic film can be easily practiced using either a known capacitance method or a known field-effect method to be employed in the field of semiconductor.

There are commonly mentioned a structural defect, an impurity level, etc. which are caused by dangling bonds and the like as the cause that a gap state is increased in the case of an amorphous silicon photosensitive drum member. This is yet clear as a matter of fact, however it can be considered that such structural defect would be present also in the case of a known carbon atom containing film.

The foregoing carbonic film to be used in this invention can be properly formed by means of vacuum vapor deposition under specific conditions as will be below detailed, which allow the formation of it.

Now, more detailed explanation will be made about the carrier transportation layer of the electrophotographic photosensitive member according to this invention.

In an inclusive sense, it is desired for the carrier transportation layer to be constituted with the foregoing carbonic film and to possess an extinction coefficient of $10^4cm^{-1}$ or less against light having an energy of 2.5 eV or less.

And in the viewpoints of chemical composition, as above described, it is desired to be constituted with the foregoing carbonic film in which a volume ratio of 50 to 95% is occupied by a diamond phase and the remainder is occupied by a polycrystalline phase, an amorphous phase, or a mixture of them.

It is also desired to be constituted with such a carbonic film that is composed of an amorphous-like carbonic structural material or a diamond-like carbonic structural material respectively containing 65 atomic % or more of carbon atom, that the nucleus of which matrix is carbon atom and that a volume ratio of 20% or less is occupied by a graphite phase.

In the latter case, it is a matter of course that an amorphous phase may be contained in the film structure in addition to said graphite phase.

Each of said diamond phase and graphite phase may be in a single crystal state or a polycrystal state as a whole. And each of them is crystalline but not amorphous. In case of diamond crystal, when it is of a large grain size, the flatness required for an electrophotographic photosensitive member is likely to be hindered. For this reason, said diamond phase is desired to be composed of a desirably small particle size state diamond. In the case where said carbonic film contains a diamond phase of such small particle size state, it brings about such effects that a band gap Egopt be increased and an electric conductivity be decreased.

As above mentioned, in a preferred embodiment, the carbonic film to constitute the carrier transporation layer contains a specific quantity of a graphite phase. Also in this viewpoint, the carbonic film to be used in this invention can be clearly distinguished from any of hydrocarbon series highly insulative straight chain organic polymers such as polyethylene and also from low-resistant graphite polycrystal films such as vacuum deposited film of black lead.

In this case, the carbonic film may be of an amorphous-like carbon, a diamond-like carbon or a mixture of them. And it is desired to be such that the quantity of a graphite phase is preferably 20% or less and more preferably, 10% or less by the volume ratio and that possesses an electric conductivity of $10^{-8}\Omega^{-1}cm^{-1}$ or less and an optical band gap Egopt of 1.5 eV or more.

In the case where the quantity of a graphite phase exceeds said value, there occurs a tendency where the charge-retentivity will be decreased and because of this, the resulting electrophotographic photosensitive member will sometimes become inapplicable.

By the way, the structure of the carbonic film to constitute the carrier generation layer in this invention can be observed, for instance, by means of Raman analysis. In the case where the carbonic film has a complete graphite structure, a sharp Raman peak is detected in the region near 1580 $cm^{-1}$. And as a disorder from the graphite structure becomes greater (that is, the crystallinity is broken to become amorphous-like structure), a new Raman peak begins appearing in the region near 1360 $cm^{-1}$ when the above Raman peak is shifted toward the high frequency side, then a shoulder starts appearing in the region near 1620 $cm^{-1}$. In addition, the width of the peak becomes wider.

Further, there will appear a peak caused by a harmonic and the like in a higher wavelength side rather than 2000 $cm^{-1}$. However, in general, it is possible to detect the above film structure using such peaks in the region of less than 2000 $cm^{1}$.

In addition, it is possible to detect the presence of a diamond phase or a graphite phase by means of electron crystal structure analysis and by observation using an electron microscope. In this case, a carbonic film prepared according to this invention is flaked by means of ion-milling or electropolishing to obtain an appropriate sample for use in detecting the presence of a diamond phase or of a graphite phase. Then, this sample is firstly subjected to electron crystal structure analysis to thereby recognize the presence of a diamond phase or of a graphite phase, then the system is switched to thereby make a bright field image thereof. And a photograph thereof is taken.

The volume ratio between a crystal phase and a non-crystal phase is estimated by the comparision of their area ratios on the resultant photograph.

The foregoing carbonic film to be used in this invention can be properly formed, for example, by means of vacuum deposition process using a hydrocarbon compound and hydrogen gas as the film forming raw materials under specific conditions which allow the formation thereof. Details of which will be below described.

The mechanism of forming the carbonic film in this invention is yet clarified. However, it can be considered in the following way for the time being that imparting an energy to a raw material gaseous molecule by exposing a raw material gas to discharge or by heating said raw material gas, subjecting a substrate to the action of an accelating electron during film forming process, accelating an ion generated during the film forming process with an electric field, impressing a magnetic field to a plasma generation region of a film forming space, etc. would lead to forming a desired carbonic film to be the above carbonic film in this invention.

For instance, as for the carbonic film the nucleus of which being carbon atom and in which a volume ratio of 50 to 95% being occupied by a diamond phase according to this invention, it can be properly formed by means of vacuum deposition process using a carbon compound such as methane, hydrogen gas and in case where necessary, a gaseous mixture containing a relevant additive as the film forming raw materials under specific conditions which allow the formation thereof.

Said vacuum deposition process can include the following processes: plasma CVD process in which a raw material gas is excited by exposing it for discharge by the action of an electric field of DC or AC to thereby deposit an objective carbon film on a substrate; ion-beam plating process in which a raw material gas is ionized in an ionization space, the resultant is taken out and irradiated against the surface of a substrate by the action of an electric field; thermal induced CVD process in which a raw material gas is activated or decomposed by the action of a thermal energy to thereby deposit an objective carbonic film on a substrate; reactive sputtering process in which a carbon target such as a graphite is subjected to the action of an accelated ion to generate carbon atom or a carbon atom containing molecular particle resulting in the formation of an objective carbonic film on a substrate; a process in which a raw material gas is excited using a charged particle such as electron rays or an ion line to thereby deposit an objective carbonic film on a substrate; a process in which a raw material gas is decomposed and coupled using a hydrogen radical or a halogen radical resulted from hydrogen gas or halogen gas by their activation with a plasma or a thermal energy to thereby deposit an objective carbonic film on a substrate; and light induced CVD process in which a raw material gas is exposed for ultraviolet of rays or laser beam to thereby deposit an objective carbon film on a substrate.

Representative embodiments of the improved electrophotographic photosensitive member according to this invention will now be explained more specifically referring to FIG. 1 and FIG. 2. The description is not intended to limit the scope of the invention.

Figure 2:
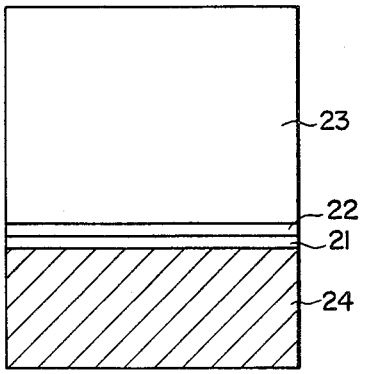
FIG. 2 is a schematic cross-sectional view illustrating another representative embodiment of an electrophotographic photosensitive member according to this invention.

In FIGS. 1 and 2, there are shown a carrier transportation layer 13, 23 constituted with the foregoing carbonic film, a carrier generation layer 12, 22, a substrate 14, 24, a surface layer 11 and a charge injection inhibition layer 21.

For the carrier transportation layer 13, 23, it is not desirable to contain a large amount of hydrogen atom, and the amount for hydrogen atom to be contained therein is 40 atomic % for the upper limit amount, and preferably, 30 atomic % or less.

That is, an excessive amount of hydrogen atom invites problems such as decrease in photosensitivity, increase in residual potential, easiness of being damaged for the surface, etc.

As for the lower limit for the amount of hydrogen atom to be structurally contained in the carbonic film, it is not particualrly limited, but in the view points of desirably increasing a charge-retentivity and decreasing a residual potential, it is preferred to be 0.01 atomic %.

In addition, the carbonic film to constitute the carrier transportation layer 13, 23 may contain nitrogen atom and/or oxygen atom in addition to the hydrogen atom. In this case, the above mentioned effects in case of incorporating hydrogen atom into the carbonic film are further enhanced.

As for the electric conductivity of the carrier transportation layer 13, 23, in the case where it is excessively large, problems such as decrease in the charge-retentivity, occurrence of an unfocused image, etc. will be often brought about. In this respect, it is desired to be such that possesses an electric conductivity of $10^{-11}\Omega^{-1}cm^{-1}$ or less.

Further as for the optical band gap Egopt of the carrier transportation layer 13, 23, it is desired to be preferably 1.5 eV or more and more preferably, 2.0 eV or more. Especially, in case of the electrophotographic photosensitive member shown in FIG. 2, it is preferred to be 2.5 eV or more.

Now, the carbonic film to constitute the carrier transportation layer 13, 23 may be amorphous or other that partially contains a crystalline structure. However, it is desired to be such that possesses structure characterized by Raman spectra in the region of 1550 to 1650 $cm^{-1}$ and in the region of 1333 $cm^{-1}$.

Especially, in the case where the carbonic film is such that contains a diamond structure in a large quantity and is near the diamond polycrystal, the heat stability, photosensitivity, mechanical strength and charge-retentivity are remarkably improved.

For the carbonic film to constitute the carrier transportation layer 13, 23, its characteristics can be desirably improved by doping it with an impurity element. Especially, in the case where it is doped with a group III element or a group V element of the Periodic Table, its film characteristics are remarkably improved.

In addition, the doping using one of the elements of group III of group V [hereinafter, referred to as "dopant (III,V)"] makes it possible to use the electrophotographic photosensitive member according to this invention under positive polarity charge, or negative polarity charge, and serves to increase the charge-retentivity, to heighten the photosensitivity and to reduce a residual potential. This is considered due to that the concentration of a charge carrier in the carrier transportation layer 13, 23 comprising the carbonic film would be changed by incorporating such dopant into the layer or the transporting property for said carrier would be changed because of doping the layer with such dopant.

For the amount of the dopant (III,V) to be contained in the carrier transportation layer 13, 23, it is preferably 5 atomic ppm to 5 atomic %, and more preferably, 50 atomic ppm to 1 atomic %.

Usable as the dopant of group III are B, Al, Ga, In, Tl, etc. And as the dopant of group V, there can be mentioned N, P, As, Sb, Bi, etc. Among these dopants, B, P, N and Al are particularly preferred.

The thickness of the carrier transportation layer 13, 23 is properly determined depending upon the requirements for the carrier transportation layer 13, 23 of an electrophotographic photosensitive member to be prepared.

However, it is preferably 1 μm to 100 μm and more preferably, 5 μm to 50 μm.

That is, in the case where the thickness of the carrier transportation layer 13, 23 is less than 1 μm, there will often occur a problem that in view of the image developing as a visualization means, a satisfactory visible image density cannot be obtained by conventional developing process.

On the other hand, in the case where the above thickness is more than 100 μm, not only a residual potential becomes greater but also there occur other problems that the adhesion with the substrate 14, 23 becomes poor and it takes an undesirably long time to form the layer.

In view of this, the thickness of the carrier transportation layer 13, 23 should be selected within the above mentioned range, and it is desirable to lie in the range from 5 μm to 50 μm.

The electrophotographic photosensitive member of which carrier transportation layer is of a thickness lying in the above mentioned specific range is indeed advantageous since the use conditions therefor can be simplified and a high density visible image may be always made even in the case where the thickness of the light receiving layer is thinner than that of the photoconductive layer of a known electrophotographic photosensitive member.

In addition to the above advantages, it is also advantageous in the viewpoint that it can be produced in a smaller cost in comparision with that required for the production of a known electrophotographic photosensitive member.

As above described, the film structure of the carbonic film to constitute the carrier transportation layer can be observed by Raman analysis. In the case where the carbonic film has a complete graphite structure, a sharp Raman peak is detected in the region near 1580 $cm^{-1}$. And as a disorder from the graphite structure becomes greater (that is, the crystallinity is broken to become amorphous-like structure), a new Raman peak begins appearing in the region near 1360 $cm^{-1}$ when the above Raman peak is shifted toward the high frequency side, then a shoulder starts appearing in the region near 1620 $cm^{-1}$. In addition, the width of the peak becomes wider.

In the case where the carbonic film has a diamond structure composed of carbon of $SP^3$, a very sharp peak is detected in the region of 1333 $cm^{-1}$. Depending upon the width of this peak, it can be determined of whether it is of a high crystallinity or of an amorphous property.

For the carbonic film to constitute the carrier transportation layer 13, 23, it is desired to be so formed as to possess a value of, preferably, 0.18 to 5. 9 and more preferably, 1.8 to 5.9 for the ratio of $I_D/I_G$ between the peak intensity ($I_D$) of 1333 $cm^{-1}$ and the peak intensity ($I_G$) of 1580 $cm^{-1}$ in Raman spectra.

For the above peak intensity of a Raman spectrum, there is employed a value which is obtained by peak-dividing the resultant Raman spectra in accordance with a conventional method in this technical field and extrapolating on each divided predetermined peak in accordance with a conventional triangular approximation method.

For the carrier generation layer 12, 22, any know layer can be employed as long as it possesses a desirable photoconductivity. As such layer, there can be mentioned, for example, a layer of 0.5 to 20 μm in thickness composed of A-Si:H series material or other A-Si:H series material containing germanium atom, carbon atom, etc. which can be properly formed by means of plasma CVD.

In the electrophotographic photosensitive member according to this invention which has a light receiving layer comprising a carrier generation layer composed of such A-Si:H series photoconductive material and a carrier transportation layer composed of the foregoing carbonic structural material, a charge carrier from the carrier generation layer becomes effectively injected into the carrier transportation layer.

Further, in the electrophotographic photosensitive member, it is possible for the carrier generation layer 12, 22 to be of rather low electric resistance (a reciprocal of the electric conductivity) than that in the conventional electrophotographic photosensitive member for the reasons that the carrier transportation layer 13, 23 is constituted with the foregoing carbonic film which excels in charge carrier transportation ability and which is of a high electric resistance.

More particularly in this respect, the carrier generation layer 12, 22 may be such that possesses a value of $10^{-10}$ Ωcm or less for the electric resistance. Because of this, it is possible to use, as the constitutent material for the carrier generation layer 12, 22, such material used difficult to be utilized for the formation of a light receiving layer in the past because of low electric resistance in spite of possessing a high photoconductivity.

The carrier transporation layer 13, 23 may contain not only hydrogen atom but also halogen atom such as fluorine atom. In this case, such atom may be contained in a state of being present only in a layer region near the free surface of the carrier transportation layer 13, 23 or in a state that it is contained so as to hold a concentration gradient directed from the side of said free surface toward the inner direction of said layer.

In the case where the carbonic film to constitute the carrier transportation layer 13, 23 is such that is near a diamond polycrystal containing a complete diamond structure in a large quantity, although the charge-retentivity, photosensitivity, surface hardness, durability and the like of the electrophotographic photosensitive member may be enhanced, the residual potential often becomes relatively high. In this connection, the carbonic film to constitute the carrier transportation layer 13, 23 is desired to be such that contains a diamond structure in a proper quantity.

The incorporation of fluorine atom in an excessive amount invites problems such as decrease in the photosensitivity, increase of a residual potential and easiness of being damaged for the surface.

On the other hand, the incorporation of fluorine atom in a limited amount brings about significant effects such as improvements not only in the cleaning properties but also in the charge-retentivity, and decrease of a residual potential on the electrophotographic photosensitive member.

In this respect, the amount of fluorine atom to be contained in the carrier transportation layer 13, 23 is preferably 15 atomic % or less, and more preferably, 10 atomic % or less.

For the electrophotographic photosensitive member, the carrier transportation layer can be placed on the carrier generation layer so as to serve as a surface layer also as shown in FIG. 2. In this case, the carbonic film to constitute the carrier transportation layer 23 is desired to be such that contains a double bond in a large quantity within the film structure and that possesses an optical band gap of 2.0 eV or more.

In order to effectively satisfy the above conditions, it is desired to incorporate hydrogen atom in a large quantity. Likewise, the incorporation of fluorine atom is also effective. Especially in the latter case, the coefficient of kinetic friction for the carrier transportation layer can be desirably lowered.

In case of FIG. 2, the carbonic film to constitute the carrier transportation layer 23 can be effectively improved to have a wealth of many practically applicable characteristics by incorporating a dopant (III,V) thereinto in an appropriate amount of 0.5 atomic % or less.

In this case, it is possible to form a desirable carbonic film to constitute the carrier transportation layer 23 which possesses a value of less than 0.5 for the coefficient of kinetic friction under the specific conditions as long as it has a carbon content of more than 65 atomic %.

Now, as above described, the carbonic film to constitute the carrier transportation layer 13, 23 is desired to be such that possesses a gap state density preferably of $5\times10^{17}cm^{-3}$ or less, and more preferably, of $1.5\times10^{17}cm^{-3}$ or less.

In the case where the carbonic film is of a considerably large gap state density, a electric charge (carrier) is easily trapped during its transportation to cause problems such as increase of a residual potential, etc. which bring about undesirable influences on the quality of an image obtained.

It is possible to form a carbonic film having such desirable gap state density as mentioned above by carrying out the film forming process under the specific conditions or by incorporating hydrogen atom, fluorine atom, nitrogen atom or oxygen atom thereinto under controlled conditions depending upon the requirement therefor.

As for the substrate 14, 24 of the electrophotographic photosensitive member according to this invention, it may be electroconductive or electrically insulating. However, in the case where photosensitive member is to be used repeatedly, at least its surface on which a light receiving layer is to be disposed is desired to be made conductive.

Usable as an electroconductive substrate are, for example, metals such as Al, Fe, Ni, Sn, Zn, Cr, Mo, Ti, Ta, W, Au, Ag, Pt, Pd and the like, or alloys such as stainless steel and other alloys of said metals, and other than these, Si, Ge or graphite.

For a purpose of improving the adhesion of the light receiving layer with the surface of such electroconductive substrate or for other purposes, said surface may be coated with other material than that of the substrate.

Usable as an electrically insulating substrate are, for example, films or sheet of synthetic resin such as polyester, polyethylene, polyurethane, polycarbonate, polystyrene, polyamide and the like, and other than these, glass or ceramics.

The size or the shape may be optionally determined. Examples of the shape are drum, belt, plate and suitable like shapes.

Now, in a preferred embodiment for the electrophotoconductive member shown in FIG. 1, it is desired to be provided with the surface layer 11.

Especially in the case where the carrier generation layer 12 is composed of A-Si:H, the provision of the surface layer 11 is effective in preventing the resulting image from being deteriorated upon using under high humid environment and also in preventing the resulting image from being worsened because of foreign matters resulted from corona discharge.

As for the constituent material for the surface layer 11, various materials can be used as long as they are somewhat transparent and are of a low electric conductivity.

Examples of such material are A-SiC(H), A-SiN(H) and the like which can be prepared by means of plasma CVD. It is of course possible to constitute the surface layer 11 with the foregoing carbonic film to constitute the carrier transportation layer 13, 23. In this case, it is desired to be such that possesses an optical band gap Egopt of 2.0 eV or more, wherein there is not any particular limitation for the electric conductivity, the amount of hydrogen atom or of fluorine atom as far as it satisfies the conditions required for the surface layer 11. As for the hydrogen atom or the fluorine atom to be incorporated into the surface layer 11, such atom may be contained in a state of being present only in a layer region near its free surface or in a state that it is contained so as to hold a concentration gradient directed from its free surface side toward the inner direction of the layer.

In case of the electrophotographic photosensitive member shown in FIG. 2, it is preferred to dispose the charge injection inhibition layer 21 between the substrate 24 and the carrier generation layer 22.

In that case, a further improvement is made in the charge-retentivity and occurrence of a defective image is effectively prevented.

It is possible for the charge injection inhibition layer 21 to be composed of a doped amorphous material such as doped A-Si(H,X) [wherein X is halogen atom], which can be formed by means of plasma CVD.

And, for the electrophotographic photosensitive member shown in FIG. 2, when it is for use in positive polarity charge, it is desired for the foregoing charge injection inhibition layer 11 to be of a p-type semiconductor property or of a low electron mobility. On the other hand, when it is for use in negative polarity charge, the foregoing charge injection inhibition layer 11 is desired to be of an n-type semiconductor property or of a low hole mobility.

In order to make the foregoing charge injection inhibition layer 11 to be of p-type or of a low electron mobility by doping it with a dopant, there can be effectively used an element of group III such as B and A( as such dopant. Likewise, an element of group V such as N, P and As can be effectively used as the dopant in order to make the foregoing charge injection inhibition layer 11 to be of n-type or of a low hole mobility.

As above described, the carbonic film to constitute the carrier transportation layer or the surface layer of the electrophotographic photosensitive member according to this invention can be properly formed by means of vacuum vapor deposition wherein raw material gases are excited, ionized or decomposed with an appropriate activation energy such as discharge energy, heat energy or light energy to thereby cause the formation of the carbonic film on the substrate.

In that event, it is possible to make the resulting carbonic film to be a desirable one having an excellent film quality and also to promote the deposition rate for the formation of such carbonic film by subjecting the substrate to the action of an accelating election during the film forming process, accelating an ion generated during the film forming process with an electric field, or impressing a magnetic field to a plasma generation region of the deposition chamber.

It is of course possible to form the carbonic film by means of reactive sputtering wherein there is used a solid carbon or other solid of which main ingredient is a carbon compound as a target.

Details of the film formation mechanism are yet clarified, but it is an important factor in order to obtain a desired carbonic film that a carbon ion, or an ion of a carbon compound and a radical of said carbon compound be generated in the film forming process in any case.

In addition, in the case where hydrogen atom is to be structurally incorporated into the film, an amount of a raw material gas imparting hydrogen atom to be fed is an important factor in order to a high quality carbonic film. In this case, it is preferred to generate to excite at least part of said raw material to thereby generate a hydrogen ion or a hydrogen radical prior to being surved for film formation.

Further, in order to form a desired carbonic film, it is effective to impress a vias voltage from a power source onto the substrate so as to make its surface on which a film is to be deposited exposed for ion impacts or to accelate an electron toward the direction of the substrate so as to excite a raw material with such electron in a space near the surface of the substrate.

In the latter case, it is possible for such electron to be supplied using a plasma or using a heated filament.

Further, even in such case where said bias voltage is not impressed onto the substrate, it is desirable to utilize such outobias caused by impressing a high frequency on the substrate side without the substrate being grounded as in the case of practicing RF Plasma chemical vapor deposition.

The temperature of the substrate upon practicing the film forming process is an important factor in order to obtain a desired carbonic film.

In general, it is preferably 250° C. or more and more preferably 450° C. or more.

Now, the conditions for forming the carrier transportation layer of the electrophotographic photosensitive member according to this invention are varied depending upon a film forming method, an apparatus to be used for practicing said method, its scale, the kind of its constituent member, the kind of a raw material to be used, etc. And respective parameters for forming said photoconductive layer cannot be usually determined with ease independent of each other but should be decided based on relative and organic relationships among those parameters.

Specifically, in the case of chemical vapor deposition utilizing glow discharge, in general, preferred parameters are: 250 to 650 W for the discharging power (Pw); $7\times10^{-4}$ to 10 Torr for the inner pressure (P) during film forming process; 250° to 700° C. for the substrate temperature (Ts); −300 to zero V for the substrate bias ($E_{SUB}$); and as for the magnetic field (H), 400 to 800 gauss in the case of RF and 875 Gauss or around this in the case of microwave.

However, in this invention, the actual condition for forming the photoconductive layer comprising a desired carbonic film are to be properly designed by selecting appropriate respective parameters from those above mentioned depending upon an apparatus to be used so that said carbonic film can be effectively formed.

In this case, a dark conductivity ($\delta_o$) for the resulting carbonic film can be appropriately reduced by properly heightening the discharging power, the substrate temperature and the substrate bias respectively. In the case where a raw material gas of a carbon compound and hydrogen gas are used, said dark conductivity can be raised by increasing the flow ratio of said raw material gas to said hydrogen gas.

As for the band gap for the resulting carbonic film, it can be enlarged by using properly selected raw material gases or by properly heightening the discharging power, the substrate temperature and the substrate bias respectively.

The amount of hydrogen atom or fluorine atom to be contained in the resulting carbonic film can be properly determined based on relative and organic relationships among the kind of a raw material, combination of different raw materials, flow rates of raw material gases, discharging power, substrate temperature, and inner pressure.

As for the coefficient of kinetic friction for the resulting carbonic film, it can be reduced by properly heightening the discharging power, the substrate temperature and the substrate bias respectively in general. In alternative, it can be reduced also by decreasing the flow rate of a raw material gas of a carbon compound in the case where it is used.

The film structure of the carbonic film to be obtained has a tendency to become taking a complete diamond structure by raising the substrate bias and the substrate temperature or/and by decreasing the gas flow ratio of a carbon atom imparting raw material gas to a hydrogen atom or halogen atom imparting raw material gas. In a reverse case of this situation, the film structure of the carbonic film to be obtained has a tendency to become taking a complete graphite structure.

In this invention, the actual conditions for forming an objective desired carbonic film are properly determined while having due regards on what are above mentioned.

Details of this situation are explained by Examples of this invention which will be under described.

Usable as the carbon compound to be used for forming the foregoing carbonic film to constitute the carrier transportation layer 13, 23 or the surface layer 11 of the electrophotographic photosensitive member according to this invention are, for example, alkane series hydrocarbons or their derivatives such as methane, ethane, propane, butane, etc.; alkylene series hydrocarbons or their derivatives such as ethylene, propylene, butylene, amylene, etc.; alkyne series hydrocarbons or their derivatives such as acetylene, pentyne, butyne, hexyne, etc.; aromatic hydrocarbons or their derivatives such as benzene, naphthalin, anthracene, toluene, xylene, pyridine, picoline, quinoline, indole, acridine, phenol, cresol, etc.; various alcohols such as methanol, ethanol, propanol, butanol, etc.; various ketones or their derivatives such as acetone, methylethyl ketone, diethyl ketone, di-isopropyl ketone, di-isobutyl ketone, diacetyl, etc.; various aldehydes or their derivatives such as acetoaldehyde, propionaldehyde, butylaldehyde, etc.; various amines or their derivatives such as methlamine, dimethylamine, trimethylamine, ethylamine, propylamine, etc.; various ethers or their derivatives such as dimethylether, methyethylether, isopropylether, methyl-n-butylether, etc.; and various acetates such as ethylacetate.

And, usable as a compound to be used in the case where fluorine atom is incorporated into the above carbonic film are, for example, fluoromethane, fluoropropane, fluorocyclohexane, methane difluoride, methane trifluoride, methane tetrafluoride, fluoroacetylene, fluorobenzene, acetyl fluoride, formyl fluoride, etc.

In order to incorporate fluorine atom into the above carbonic film, it is a matter of course that the sole use of a fluorine gas is effective.

And as for the above mentioned fluorine compounds, one or more of them can be independently used.

Other than the above case, one or more of them can be used together with a hydrocarbon compound or together with a hydrogen gas.

In the case where the chosen fluorine compound is in a liquid state or in a solid state, it is contacted with a carrier gas such as Ar, $H_2$, etc. and if necessary, while being heated to thereby generate a gas of the compound, which is then introduced into the deposition chamber.

It is possible to introduce other halogen gas or/and ammonia gas together with such gaseous substances as above mentioned.

In the case where a dopant (III,V) is incorporated into the above carbonic film, a hydrogenated substance such as $BH_3$, $B_2H_6$, $PH_3$, $AsH_3$ or $NH_3$, or other than these, $Al(CH_3)_3$ or $Ga(CH_3)_3$ can be desirably used as a raw material to impart the dopant (III,V).

Explanation will be now made about representative fabrication apparatuses suited for practicing the film forming process of the foregoing carbonic film to constitute the carrier transportation layer or the surface layer of the electrophotographic photosensitive member according to this invention.

Figure 3:
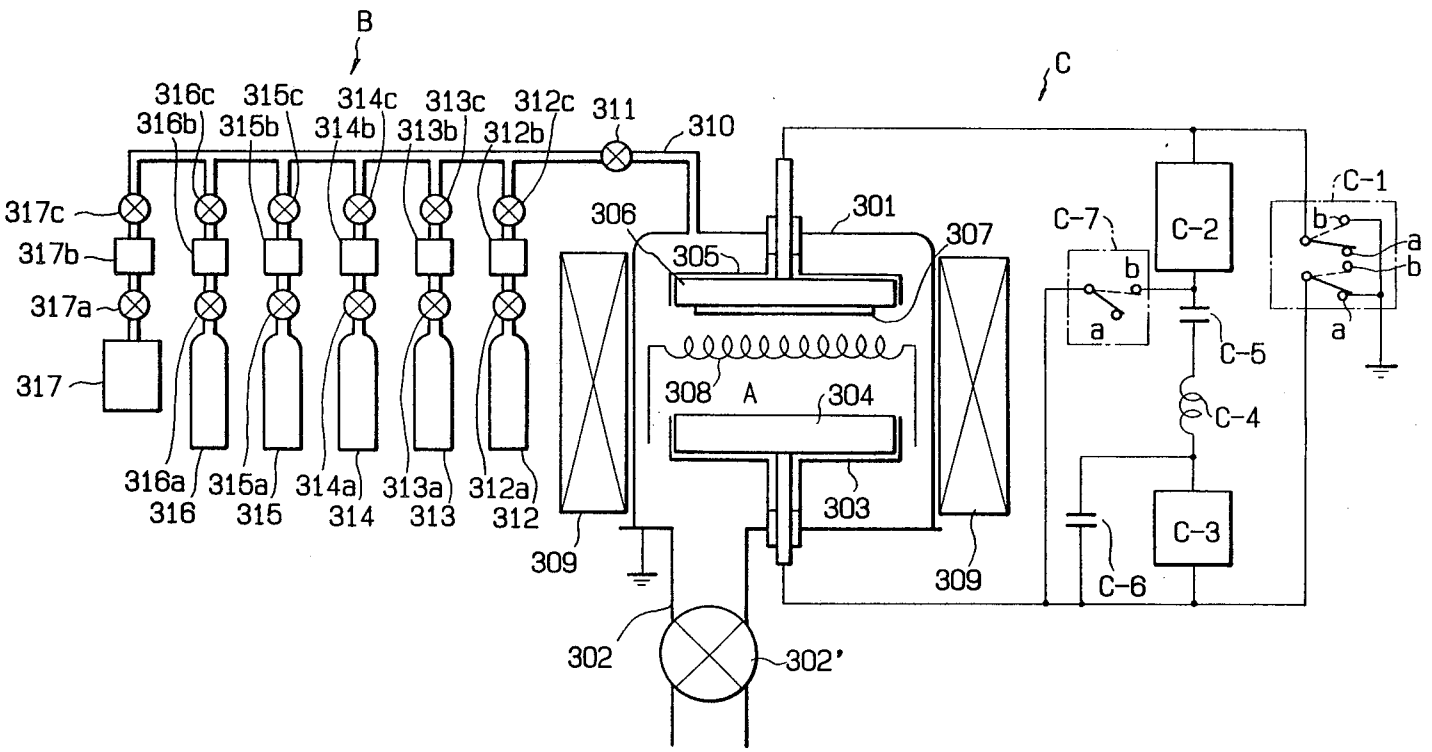
FIG. 3 is a schematic explanatory view of a fabrication apparatus as an example of the apparatus for preparing the electrophotographic photosensitive member according to this invention.

In FIG. 3, there is shown one of such representative fabrication apparatus.

The apparatus shown in FIG. 3 comprises a deposition chamber, a gas supplying system B and a high frequency supplying system C.

In FIG. 3, there is shown a substantially enclosed cylindrical deposition chamber 301 with which a water cooling means capable of cooling its entire part is provided (not shown). With the bottom of which, there is provided an exhaust pipe 302 being connected though a main valve 302' to a vacuum pump (not shown). Numerals 304 and 306 stand for electrodes which are arranged in film forming space A of the deposition chamber 301 so that a voltage of direct current (DC) or alternating current (AC) can be impressed. Numeral 303 is a guard-electrode for the electrode 304 and numeral 305 is a guard-electrode for the electrode 306. On the surface of the electrode 304, it is possible to place a target for reactive sputtering.

Numeral 307 is a substrate placed on the surface of the electrode 306. Numeral 308 is an electric heater for the substrate 307 which is made of a metal such as tungsten, tantalum, etc., and which is so installed in the film forming space A that its position can be automatically adjusted (not shown). The electric heater 308 may be of a wire shape or a coil shape, or other than these, it may be a wire net. And, in order to actuate the electric heater 308, an AC power, for example, of 50 Hz is impressed thereto. Not only the deposition chamber but also the guard-electrodes 303 and 305 are electrically grounded. As for the grounding means for the guard-electrodes 303 and 305 (not shown), they are removably provided.

With the circumferential outer wall face of the deposition chamber 301, a metal coil 309 is windingly provided. In case where necessary, a DC is impressed to the metal coil 309 to thereby cause a static magnetic field in the film forming space A.

In the high frequency supplying system C, there is shown a high frequency power source C-2 of 13.56 MHz which is so designed that its machine can be made depending upon a load impedance. And there are also shown a DC power source C-3, capacitors C-5 and C-6, and an inductance coil C-4. In the high frequency supplying system C, there are provided alternation circuits C-1 and C-7 in order to shunt a high frequency impressing side one to the other between the electrodes 304 and 306.

In the gas supplying system, there is shown a raw material gas feed pipe 310 which is connected to the deposition chamber 301. Numerals 312 through 316 are gas reservoirs for gases to be used for forming the carbonic film such as raw material gas, dopant imparting raw material gas, carrier gas and etching raw material gas.

Numeral 317 is a vaporizer for a raw material liquid, in which a carrier gas such as hydrogen gas and argon gas can be introduced in case where necessary.

The feed pipe 310 is connected through a control valve 311 and gas pipes to the respective reservoirs 312 through 316 and also to the vaporizer 317.

With the respective gas pipes, there are provided control valves 312*a* through 317*a*, another control valves 312*c* through 317*c* and mass flow controllers 312*b* through 317*b* respectively.

Figure 4:
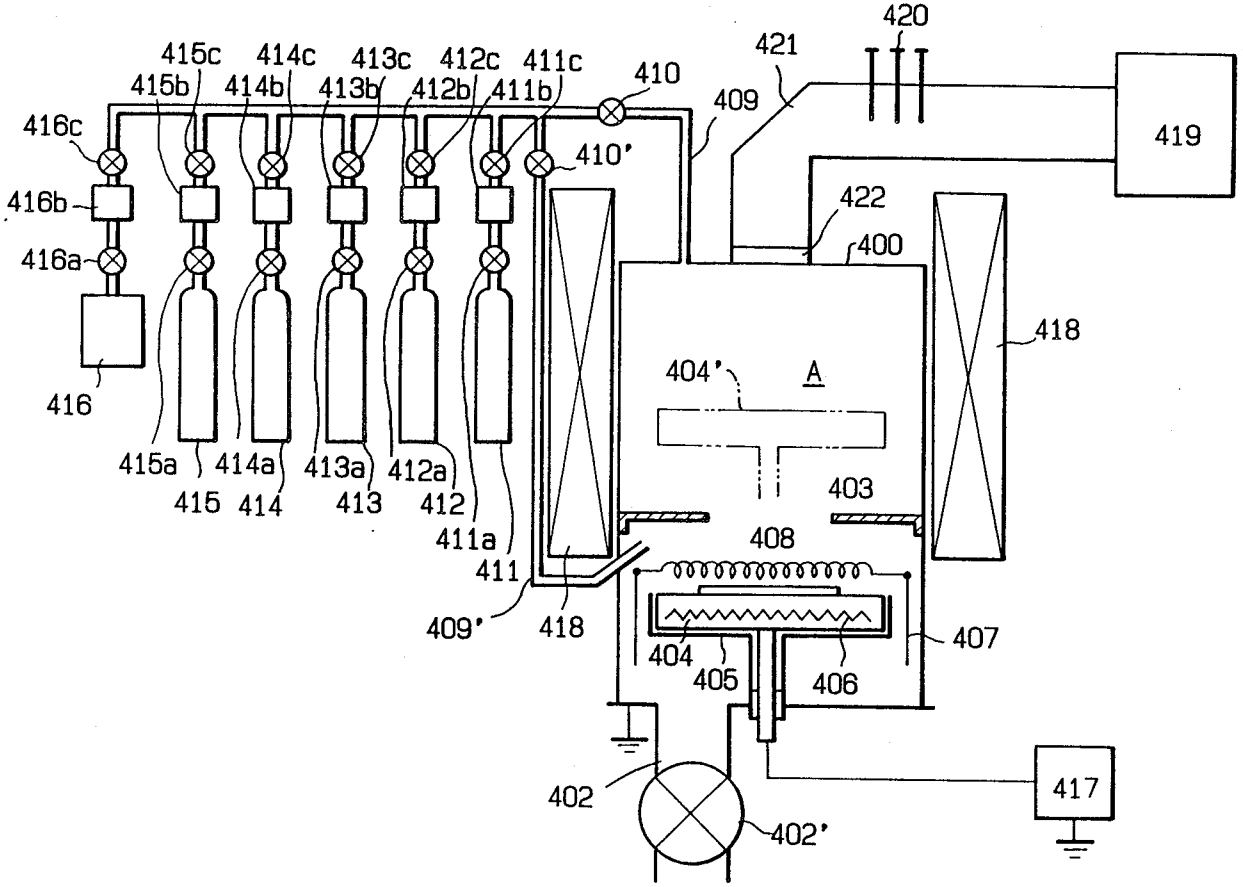
FIG. 4 is a schematic explanatory view of a fabrication apparatus as another example of the apparatus for preparing the electrophotographic photosensitive member according to this invention.

In FIG. 4, there is shown another representative apparatus suited for practicing the film forming process of the foregoing carbonic film to constitute the carrier transportation layer or the surface layer of the electrophotographic photosensitive member according to this invention.

In FIG. 4, numeral 400 stands for a substantially enclosed deposition having film forming space A, with which an exhaust pipe 402 is provided. The exhaust pipe 402 is connected through a main valve 402' to a vacuum pump (not shown).

In the middle of the upper wall of the deposition chamber 400, there is embedded a microwave introducing window 422 made of a microwave hardly absorptive material such as a quartz place in a state to form a part of said upper wall. Numeral 403 is a substrate which is placed on the surface of a substrate holder 402 in which an electric heater 406 is installed. Numeral 405 is a guard-electrode. Numeral 407 is an electric heater for substrate 403. The substrate holder 404 is provided in a state being insulated from being grounded. Numeral 417 is a DC power source to impress a voltage thereonto. Numeral 408 stands for a parting strip, which is slidably provided with the inner face of the circumferential side wall of the deposition chamber in the way to allow its upward and downward movements. The parting strip 408 serves to reflect a microwave introduced through the window 422 and to make the microwave effectively absorbed into raw material gases and the like which are fed into the film forming space.

In the apparatus shown in FIG. 4, the substrate holder 404 is so installed that it can be lifted to the position of 404' in the film forming space A in case where necessary.

Numeral 421 is a waveguide for a microwave from a microwave power source 419, which is connected through the microwave introducing window 422 to the deposition chamber 400. With the waveguide 421, there is provided a tuner 420 serving for the matching of an impedance.

With the circumferential outer wall face of the deposition chamber 400, a metal coil 418 is windingly provided. In case where necessary, a DC is impressed to the metal coil 418 to thereby cause a static magnetic field in the film forming space A.

Numeral 409 is a gas feed pipe of a gas or gases from servoirs 411 through 415 and a vaporizer, which is open through the upper wall of the deposition chamber 400 into the film forming space A.

Numeral 409' is a branched gas feed pipe from the gas feed pipe 409, which is open through the circumferential side wall of the deposition chamber 400 into a lower part of the film forming space A.

The reservoirs 411 through 415 serves to store gases to be used for forming the carbonic film such as raw material gas, dopant imparting raw material gas, carrier gas and etching raw material gas.

Numeral 416 is a vaporizer for a raw material liquid, in which a carrier gas such as hydrogen gas and argon gas can be introduced in case where necessary.

Numerals 411*a* through 416*a* and 411*c* through 416*c* are valves for controlling the flow rates of the gases from the reservoirs 411 through 415 and the flow rate of the gas from the vaporizer 416.

Numerals 411*b* through 416*b* are mass flow controllers. And numerals 410 and 410' are valves having two functions to operate as both regulation valves and switching valves.

Figure 5:
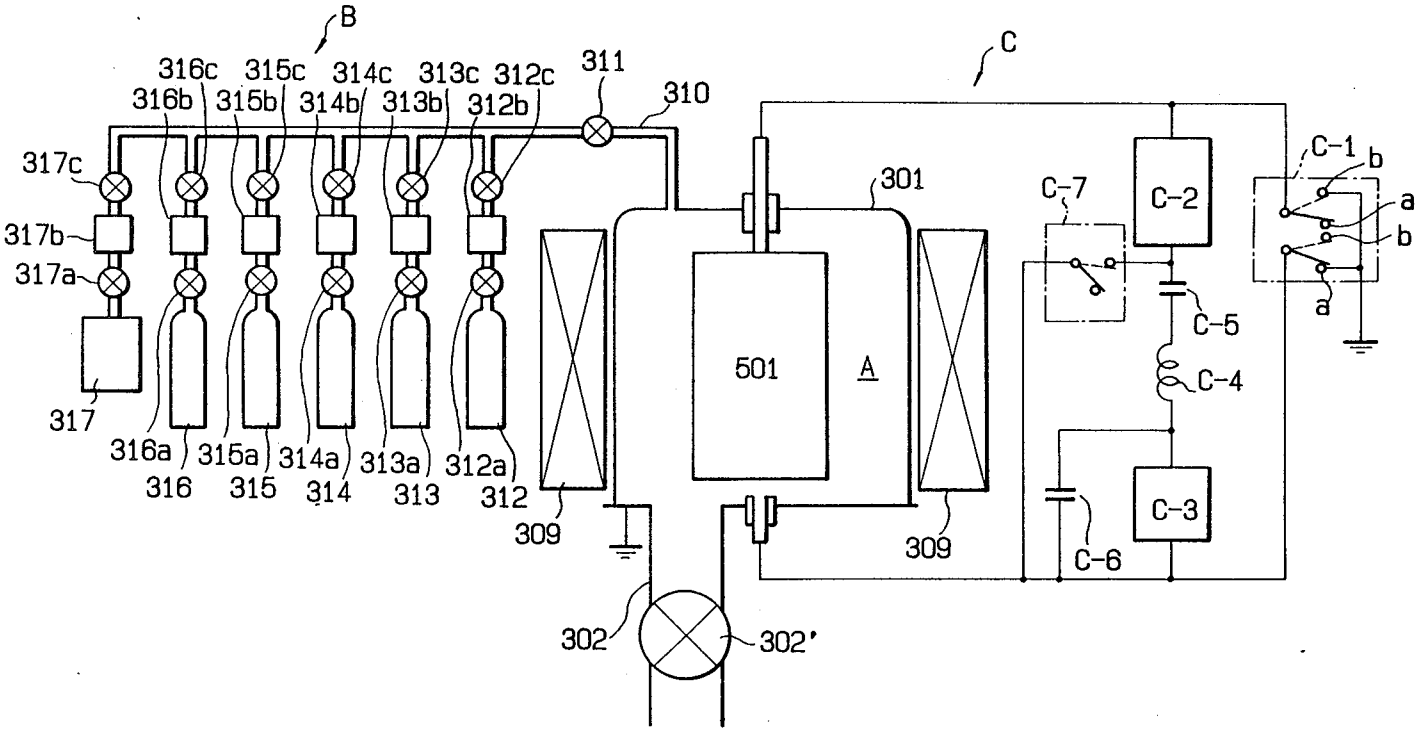
FIG. 5 is a schematic explanatory view of a fabrication apparatus as a further example of the apparatus for preparing the electrophotographic photosensitive member according to this invention.

In FIG. 5, there is shown a further representative apparatus suited for practicing the film forming process of the foregoing carbonic film to constitute the carrier transport layer or the surface layer of the electrophotographic photosensitive member according to this invention.

The apparatus shown in FIG. 5 is a partial modification of the apparatus shown in FIG. 3, in which a cylindrical substrate can be used.

In FIG. 5, numerals are the same as those in FIG. 3, except that numeral 501 stands for a cylindrical substrate.

In the apparatus shown in FIG. 5, the cylindrical substrate 501 is electrically connected to the power sources C-2 and C-3. And, the inner wall of the deposition chamber 301 is electrically connected to the power sources C-2 and C-3 so as to act as a counter electrode.

PREFERRED EMBODIMENT OF THE INVENTION

EXAMPLE 1

There was prepared an electrophotographic photosensitive member having the layer structure shown in FIG. 1 using the fabrication apparatus shown in FIG. 3.

There was used a circular n-type silicon wafer having an electric conductivity of about $10^{-2}\Omega^{-1}cm^{-1}$ as the substrate 307.

After an oxide film deposited on the surface of the circular substrate being removed with a diluted solution of fluoric acid, it was attached to the upper electrode 306. The deposition chamber was substantially enclosed, and the air of the film forming space was evacuated by opening the main valve 302' to bring the chamber to a vacuum of about $2\times10^{31\ 7}$ Torr. Then, an AC power of 50 Hz was impressed to the tungsten coil electric heater 308 being so installed as to position along and over the circular substrate 307 in the film forming space A and the heater was heated to about 2500° C. to thereby cause a radiant heat. Using which heat, the circular substrate was heated until the temperature of its reverse side which is not faced to the heater 308 becomes to be about 450° C. [measured using a thermocouple (not shown)]. Thereafter, the temperature of the heater 308 was reduced to about 2000° C. to thereby make the temperature of the circular substrate stable.

Then, a DC power was impressed to the metal coil 309 to make the magnetic field on the upper inner face part of the circumferential side wall of the deposition chamber to be 800 Gauss.

The switching positions in the alternation circuits C-7 and C-1 were turned to the position a and the polarity of the DC power source C-3 was so adjusted that the circular substrate side became −300 V.

Thereafter, minimizing the mass flow controllers 312*b* and 313*b*, the valves 312*a* and 312*c* for the reservoir 312 in which $CH_4$ being stored and the valves 313*a* and 313*c* for the reservoir 313 in which $H_2$ being stored were opened.

Successively, the mass flow controllers 312*b* and 313*b* were so regulated that the flow rates of $CH_4$ gas from the reservoir 312 and $H_2$ gas from the reservoir 313 became 5 SCCM and 100 SCCM respectively. In this event, the inner pressure of the film forming space was 0.002 Torr.

Then, the power source C-2 was switched on to thereby start discharging under the condition of power supply of 350 W. After 48 hours since the discharge and the inner pressure became stable, the power sources C-2 and C-3 were switched off to stop charging, and the valves 312*c* and 313*c* were closed to stop supplying said gases at the same time.

In this way, a carrier transportation layer constituted with a carbonic film of about 8 μm in thickness was deposited on the circular substrate 307.

Then, after the temperature of the substrate being reduced to 250° C. by adjusting the power source for the heater, the switching positions of the alternation circuits C-1 and C-7 were turned to the position b respectively. Opening the valves 314*a* and 314*c* for the reservoir 314 in which $SiH_4$ gas being stored and the valves 313*a* and 313*c* for the reservoir 313 in which $H_2$ gas being stored, the mass flow controllers 314 and 313 were so regulated that the flow rates of $SiH_4$ gas and of $H_2$ gas become 10 SCCM and 90 SCCM respectively.

Then, the power source C-2 was switched on.

As a result, a carrier generation layer composed of A-Si:H of about 1 μm in thickness was deposited on the previously formed carrier transportation layer.

Successively, opening the valve 316*a* and 316*c* for the reservoir 316 in which $C_2H_2$ gas being stored, $C_2H_2$ gas was intermixed in a mixture of $SiH_4$ gas and $H_2$ gas using the mass flow controller 316*b*. As a result, a surface layer composed of A-Si:H:C was deposited in a thickness of 1000 Å on the above carrier generation layer composed of A-Si:H. After all the constituent layers being continueously deposited in this way, the valves 311 and 312*c* through 316*c* were closed, the power source for the heater 308 was switched off and the circular substrate was sufficiently cooled. Breaking the vacuum of the deposition chamber 301, the circular substrate having the foregoing deposited layers thereon was taken out therefrom.

The resultant electrophotographic photosensitive member was set to a experimental electrophotographic copying machine to examine its electrophotographic characteristics.

As a result, it exhibited a high charge-retentivity and an excellent photosensitivity.

Further, as a result of subjecting the resultant electrophotographic photosensitive member to negative charge, image exposure and toner development using said copying machine, there was obtained an excellent toner image.

Independently, a plurality of carbonic film samples were prepared under the same film forming conditions as in the case of forming the foregoing carrier transportation layer, for measuring an optical band gap, electric conductivity, Raman spectrum and the concentration of the hydrogen atom contained in the carrier transportation layer.

As a result of measuring, it could be estimated that the optical band gap of the carrier transportation layer is 3.2 eV, its electric conductivity is $10^{-14}\Omega^{-1}cm^{-1}$, and the carrier transportation layer contains hydrogen atom in a concentration of 5 atomic %. Further, as a result of measuring the Raman spectrum, there was observed a clear Stokes line in the region containing 1333 $cm^{-1}$.

EXAMPLE 2

The procedures of Example 1 were repeated, except that the conditions for forming the carrier transportation layer were changed as below mentioned, to thereby obtain an objective electrophotographic photosensitive member.

The film forming condition employed;

| | | |
|---|---|---|
| gas used and its flow rate | $CH_3OH$ | 10 SCCM |
| | $H_2$ | 100 SCCM |
| substrate bias | −100 V | |
| substrate temperature | 450° C. | |
| heater (filament) temperature | 2400° C. | |
| RF power | 300 W | |
| magnetic field | 600 Gauss | |
| Inner pressure | 10 Torr | |

As a result of examining the electrophotographic characteristic of the resultant electrophotographic photosensitive member in the same way as im Example 1, it exhibited a high charge-retentivity and an excellent photosensitivity. In addition, as a result of subjecting the resultant electrophotographic photosensitive member to negative charge, image exposure and toner development, there was obtained an excellent toner image.

Independently, a carbonic film sample having only a carrier transportation layer on the substrate was prepared under the same film forming conditions as in the case of forming the foregoing carrier transportation layer for use in chemical analysis.

As a result of examining the chemical composition of the resultant sample, it could be estimated that the carrier transportation layer contains oxygen atom. Further, as a result of measuring a concentration of hydrogen atom in the carbonic film with a infrated absorption spectrum, it could be estimated that the carrier transportation layer contains hydrogen atom in a concentration of 11 atomic %.

Further, a plurality of carbonic film samples of 2 μm in thickness were prepared under the same film forming conditions as in the case of forming the foregoing carrier transportation layer for measuring an optical band gap and an electric conductivity.

As a result, it also could be estimated that the optical band gap is 2.8 eV and the electric conductivity in a dry atmosphere is $4\times10^{-14}\Omega^{-1}cm^{-1}$.

EXAMPLE 3

The procedures of Example 1 were repeated, except that the conditions for forming the carrier transportation layer were changed as below mentioned, to thereby obtain an objective electrophotographic photosensitive member. That is, a mixture of $C_2H_6$ gas, $H_2$ gas and $NH_3$ gas was used for preparing the carrier transportation layer, and the each flow rate of $C_2H_6$ gas, $H_2$ gas and $NH_3$ gas was respectively 10 SCCM, 87 SCCM and 35 SCCM.

The other film forming conditions employed in this case were as follows;

| | |
|---|---|
| inner pressure | 0.006 Torr |
| RF power | 350 W |
| substrate bias | −230 V |
| substrate temperature | 550° C. |

-continued

| | |
|---|---|
| magnetic field | 800 Gauss |

As a result of measuring the samples which were prepared under the same film forming conditions as in the case of forming the foregoing carrier transportation layer for measuring physical properties, it could be estimated that the optical band gap is 3.1 eV, and the electric conductivity is $10^{-3}\Omega^{-1}cm^{-1}$. It also could be estimated that the concentration of hydrogen atom contained in the carrier transportation layer is 7 atomic %, and the oxygen atom is further contained in it.

In addition, the resultant electrophotographic photosensitive member was set to a experimental electrophotographic coping machine in the same way as in Example 1 for examining its electrophotographic characteristic. As a result, it exhibited a high charge-retentivity and an excellent photosensitivity. Further, as a result of subjecting the resultant electrophotographic photosensitive member to positive charge, image exposure and toner development, there was obtained an excellent toner image.

EXAMPLE 4

The procedures of Example 1 were repeated, except that the conditions for forming the carrier transportation layer were changed as below mentioned, to thereby obtain an objective electrophotographic photosensitive member.

That is, a mixture of $CH_4$ gas and $H_2$ gas was used for preparing the carrier transportation layer and the each flow rate of $CH_4$ gas and $H_2$ gas was respectively 5 SCCM and 100 SCCM.

The other film forming conditions employed in this case were as follows;

| | |
|---|---|
| RF power | 450 W |
| substrate bias | 0 V |
| substrate temperature | 250° C. |
| inner pressure | 0.1 Torr |

As a result of examining electrophotographic characteristics in the same way as in Example 1, it exhibited a high charge-retentivity. Further, as a result of subjecting it to positive charge, there was a high quality toner image.

As a result of measuring physical properties of the samples which were prepared under the same film forming condition as in the case of forming the foregoing carrier transportation layer, it could be estimated that the optical band gap of the carrier transportation layer is 2.3 eV and its electric conductivity is $10^{-13}\Omega^{-1}cm^{-1}$. Further, it also could be estimated that the carrier transportation layer contains hydrogen atom in the concentration of 11 atomic %.

EXAMPLE 5

The procedures of Example 1 were repeated, except that the conditions for forming the carrier transportation layer were changed as below mentioned, to thereby obtain an objective electrophotographic photosensitive member.

That is, a mixture of $CH_4$ gas and $H_2$ gas was used for preparing the carrier transport layer and the each flow rate of $CH_4$ gas and $H_2$ gas was respectively 5 SCCM and 95 SCCM. Further, $B_2H_6/H_2$ (1 mol %) gas was fed at a flow rate of 0.5 SCCM.

The other film forming conditions employed in this case were as follows;

| | |
|---|---|
| inner pressure | 0.06 Torr |
| substrate temperature | 350° C. |
| RF power | 250 W |
| substrate bias | −100 V |

As a result of examining electrophotographic characteristics of the resultant electrophotosensitive member in the same way as in Example 1, it exhibited a high charge-retentivity. Further, as a result of subjecting it to positive charge, there was obtained an excellent toner image.

As a result of measuring in the same way as in Example 1, it could be estimated that the optical band gap of the carrier transportation layer prepared under the foregoing film forming conditions is 2.1 eV and its electric conductivity is $4\times10^{-12}\Omega^{-1}cm^{-1}$. It also could be estimated that the carrier transportation layer contains hydrogen atom in a concentration of 17 atomic %.

EXAMPLE 6

There was prepared an electrophotographic photosensitive member having the layer structure shown in FIG. 2 using the fabrication apparatus shown in FIG. 5.

In this example, there was used an aluminum cylinder as the substrate 501.

Firstly, the air in the deposition chamber was evacuated to bring the film forming space to about $2\times10^{-7}$ Torr, and the substrate was heated to a temperature of 230° C. Then, $SiH_4$ gas, $H_2$ gas and $B_2H_6$ gas were fed at flow rates of 10 SCCM, 90 SCCM and 0.5 SCCM respectively under the inner pressure condition of about 0.1 Torr while supplying a RF power of 150 W.

As a result, a charge injection inhibition layer composed of A-Si:H containing boron atom (B) in a high concentration was deposited in a thickness of 1000 Å on the substrate. Successively, regulating the flow rates of $SiH_4$ gas and $B_2H_6$ gas to 0 respectively, only $H_2$ gas was fed for an hour while discharging. Then, $SiH_4$ gas and $H_2$ were fed again at flow rates of 10 SCCM and 90 SCCM respectively while discharging. At a result, a carrier generation layer composed of A-Si:H was deposited in the thickness of about 1 μm on the previously formed charge injection inhibition layer.

Thereafter, the feed of $SiH_4$ gas and $H_2$ gas was discontinued, and the air in the deposition chamber was evacuated to bring the film forming space to $4\times10^{-7}$ Torr. Then, a carrier transportation layer was deposited in the following way.

That is, $H_2$ gas containing 3 mol % of acetone ($CH_3COCH_3$) was produced using the vaporizer 317, which was successively fed into the deposition chamber.

The other film forming conditions employed in this case were as follows;

| | |
|---|---|
| flow rate | 200 SCCM |
| inner pressure | 1 Torr |
| RF power | 450 W |
| substrate bias | −70 V |
| magnetic field | 500 Gauss |

Then, the resultant electrophotographic photosensitive member was set to a remodeled Canon's electrophotographic copying machine NP 7550 for experimental purposes (product of Canon Kabushiki Kaisha) to evaluate its image making function. As a result, there was obtained an excellent toner image.

In addition, as a result of measuring the physical properties in the same way as in Example 1, it could be estimated that the optical band gap of the resultant carrier transportation layer is 3.2 eV, its electric conductivity is $6\times10^{-13}\Omega^{-1}cm^{-1}$.

It also could be estimated that the carrier transportation layer contains hydrogen atom in a concentration of 12 atomic %.

EXAMPLE 7

An electrophotographic photosensitive member having the layer structure shown in FIG. 1 was prepared using the fabrication apparatus shown in FIG. 4 in the following way.

The film forming conditions for a carrier transportation layer employed;

| | |
|---|---|
| gas used and its flow rate | $C_2H_4$ 5 SCCM<br>$H_2$ 50 SCCM |
| microwave power | 600 W (2.45 GHz) |
| inner pressure | $7\times10^{-4}$ Torr |
| magnetic field* | 875 Gauss |

*there was made so as to cause an electron cyclotron resonance.

Under the above conditions, the position of the parting strip 408 was so adjusted that the deposition chamber 400 could act as a cavity resonator for microwave. The resulting gas plasmas were made to blow through the opening of the parting strip 408 into the film forming space wherein the substrate being placed.

Then, the substrate temperature was controlled to 350° C., and the substrate bias was made to be −150 V.

As a result, a carrier transportation layer constituted with a carbonic film was deposited on the substrate in a thickness of 9.3 μm.

Successively, a carrier generation layer composed of A-Si:H was prepared in the following way. That is, switching off the power source for the heater 408, the temperature of the substrate was lowered to 100° C. Then, said power source was again switch on to thereby make the temperature of the substrate maintained stable at 200° C. Thereafter, $SiH_4$ gas and $H_2$ gas were fed at flow rates of 10 SCCM and 50 SCCM respectively under the inner pressure condition of $2.6\times10^{-3}$ Torr and the microwave was applied into the magnetic field of 875 Gauss, to thereby obtain a carrier generation layer composed of A-Si:H of about 1 μm in thickness on the previously formed carrier transportation layer.

Repeating the above procedures except that $CH_4$ gas, $SiH_4$ gas and $H_2$ gas were fed at flow rates of 7 SCCM, 3 SCCM and 50 SCCM respectively, a surface layer was deposited on the above carrier generation layer, to thereby obtain an objective electrophotographic photosensitive member.

The resultant electrophotographic photosensitive member was set to a conventional experimental electrophotographic machine to examine its electrophotographic characteristics in the same way as in Example 1. As a result, it was found that it excels in charge-retentivity and also in photosensitivity. And, as a result of subjecting it to negative charge, image exposure and toner development, a high quality toner image could be repeatedly obtained.

In addition, as a result of measuring the physical properties in the same way as in Example 1, it could be estimated that the optical band gap of the resultant carrier transportation layer is more than 3.0 eV and its electric conductivity is $10^{-15}\Omega^{-1}cm^{-1}$.

Further, it also could be estimated that there is present a slight amount of hydrogen atom in the resultant carrier translation layer.

EXAMPLE 8

The procedures of Example 1 were repeated, except that the conditions for forming the carrier transportation layer were changed as below mentioned, to thereby obtain an objective electrophotographic photosensitive member.

That is, a mixture of $C_2H_4$ gas and $H_2$ gas was used for preparing the carrier transportation layer and the each flow rate of $C_2H_4$ and $H_2$ gas was respectively 5 SCCM and 100 SCCM. Further, $PH_4/H_2$ (10 mol %) gas fed at a flow rate of 0.5 SCCM.

The other film forming conditions employed in this case were as follows;

| | |
|---|---|
| inner pressure | 0.3 Torr |
| substrate temperature | 350° C. |
| RF power | 600 W |
| magnetic field | 400 Gauss |
| substrate bias | −200 V |

As results of examining a electrophotographic characteristics of the resultant electrophotographic photosensitive member in the same way as in Example 1, a high quality toner image could be obtained under negative charge. Further, as a result of measuring a concentration for hydrogen atom in the same way as in Example 1, it could be estimated that the carrier transportation layer contains hydrogen atom in a concentration of 7 atomic %.

EXAMPLE 9

There was prepared an electrophotographic photosensitive member having the layer structure shown in FIG. 2 in the way similar to Example 6 as below mentioned, using the fabrication apparatus shown in FIG. 5.

In this example, there was used an aluminum cylinder as the substrate 501.

Firstly, the air in the deposition chamber 301 was evacuated to bring the film forming space to about $6\times10^{-7}$ Torr, and the substrate was heated to a temperature of 230° C. Then, $SiH_4$ gas, $H_2$ gas and $B_2H_6$ gas were fed at flow rates of 30 SCCM, 180 SCCM and 1.5 SCCM respectively under the inner pressure condition of about 0.1 Torr while supplying a RP power of 500 W.

As a result, a charge injection inhibition layer composed of A-Si:H containing boron atom (B) in a high concentration was deposited in a thickness of 100 Å on the substrate.

Successively, regulating the flow rates of $SiH_4$ gas and $B_2H_6$ gas to 0 respectively, only $H_2$ gas was fed for an hour while discharging. Then, $SiH_4$ gas and $B_2H_6$ were fed again at flow rates of 30 SCCM and 180 SCCM respectively while discharging.

As a result, a carrier generation layer composed of A-Si:H was deposited in the thickness of about 1 μm on the previously formed charge injection inhibition layer.

Thereafter, the feeds of $SiH_4$ gas and $H_2$ gas were discontinued, and the air in the deposition chamber was evacuated to bring the film forming space to $4\times10^{-7}$ Torr. Then, a carrier transportation layer was deposited in the following way.

That is, $H_2$ gas containing 3 mole % of acetone ($CH_3COCH_3$) was produced using the vaporizer 317, which was successively fed into the deposition chamber.

The other film forming conditions employed were as follows;

| | |
|---|---|
| flow rate | 300 SCCM |
| inner pressure | 0.7 Torr |
| RF power | 650 W |
| substrate bias | −110 V |
| magnetic field | 600 Gauss |

Then, the resultant electrophotographic photosensitive member was set to a remodeled Canon's electrophotographic copying machine NP 7550 for experimental purposes (product of Canon Kabushiki Kaisha) to evaluate its image making function. As a result, there was obtained an excellent toner image. It was also found that the original image quality was maintained even after 1,200,000 shots.

In addition, as a result of measuring the physical properties in the same way as in Example 1, it could be estimated that the optical band gap of the resultant carrier transportation layer is 3.6 eV, its electric conductivity is $8.6\times10^{-12}\Omega^{-1}cm^{-1}$.

It also could be obtained that the carrier transportation layer contains hydrogen atom in a concentration of 5 atomic %.

COMPARATIVE EXAMPLE 1

There was prepared an electrophotographic photosensitive member having the layer structure shown in FIG. 1 in the same procedures as Example 1, except that the switching positions of the alteration circuits C-1 and C-7 were turned to the position b and the conditions for forming the carrier transport layer were changed as below shown.

| | |
|---|---|
| gas used and its flow rate | $C_2H_6$ 10 SCCM<br>$H_2$ 90 SCCM |
| inner pressure | 5 Torr |
| RF power | 250 W |
| substrate temperature | 200° C. |
| heater (filament temperature) | 800° C. |

In this case, the metal coil was not impressed, to thereby make no magnetic field around the substrate. As a result, the thickness of the resultant carrier transportation layer was 18 μm.

Further, as a result of examining the resultant electrophotographic photosensitive member using a experimental electrophotographic coping machine in the same way as in Example 1, it was confirmed that there was practically problematic in the viewpoint of durability.

In addition, as a result of measuring the physical properties in the same way as in Example 1, it could be estimated that the optical band gap of the resultant carrier transportation layer is 2.45 V its electric conductivity is about $10^{-12}\Omega^{-1}cm^{-1}$. It also could be estimated that the carrier transportation layer contains hydrogen atom in a concentration of 63 atomic %.

COMPARATIVE EXAMPLE 2

There was prepared an electrophotographic photosensitive member in the same procedures as Example 1, except that the conditions for forming the carrier transportation layer were changed as below shown.

| | |
|---|---|
| gas used and its flow rate | $C_2H_4$ 5 SCCM<br>$H_2$ 120 SCCM |
| inner pressure | 0.03 Torr |
| RF power | 450 W |
| substrate bias | 0 V |

In this case, at the beginning of the forming the carrier transportation layer, the temperature of the substrate was adjusted to 450° C., and thereafter the power source of the heater 308 was switched off. Further, the voltage of the DC power source C-3 was adjusted to 0 V, and the switching position of the alternation circuits C-1 and C-7 were turned to the position a respectively during the forming carrier transportation layer while magnetic field was not utilized.

As a result, the thickness of the resultant carrier transportation layer was 8 μm.

Further, as a result of examining the resultant electrophotographic photosensitive member using a experimental electrophotographic coping machine in the same way as in Example 1, it was confirmed that there was practically problematic in the viewpoint of photosensitivity.

In addition, as a result of measuring the physical properties in the same way as in Example 1, it could be estimated that the optical band gap of the resultant carrier transportation layer is 1.43 eV and its electric conductivity is $3\times10^{-10}\Omega^{-1}cm^{-1}$. It also could be estimated that the carrier transportation layer contains hydrogen atom in a concentration of 8 atomic %.

EXAMPLE 10

There was prepared an electrophotographic photosensitive member using the fabrication apparatus shown in FIG. 3.

In this example, there was used an aluminum circular substrate.

Firstly, the air in the deposition chamber 301 was evacuated to bring the film forming space to about $2\times10^{-7}$ Torr, and the substrate was heated to a temperature of 230° C. Then, $SiH_4$ gas, $H_2$ gas and $B_2H_6$ gas were fed at flow rates of 10 SCCM, 90 SCCM and 0.5 SCCM respectively under the inner pressure condition of about 0.1 Torr while supplying a RF power of 150 W.

As a result, a charge injection inhibition layer composed of p-type A-Si:H was deposited in a thickness of 1000 Å on the substrate.

Successively, regulating the flow rate of $B_2H_6$ gas to 0, $SiH_4$ gas and $H_2$ gas were fed at the flow rates of 10 SCCM and 90 SCCM respectively while discharging. As a result, a carrier generation layer composed of A-Si:H was deposited in a thickness of about 1 μm on the previously formed charge injection inhibition layer.

Thereafter, the feeds of $SiH_4$ gas and $H_2$ gas were discontinued, and the air in deposition chamber was evacuated to bring the film forming space to $5.3\times10^{-7}$ Torr. Then, a carrier transportation layer was deposited in the following way.

That is, $H_2$ gas containing 5 mole % of aceton ($CH_3COCH_3$) was produced using the vaporizer 317, which was successively fed into the deposition chamber.

The other film forming conditions employed were as

| | |
|---|---|
| flow rate | 200 SCCM |
| inner pressure | 1 Torr |
| RF power | 450 W |
| substrate temperature | 350° C. |
| substrate bias | −70 V |
| magnetic field | 500 Gauss |

As a result, the carrier transportation layer constituted with a carbonic film was deposited in a thickness of 1.5 μm on the previously formed carrier generation layer.

The resultant electrophotographic photosensitive member was set to a conventional experimental electrophotographic machine to examine its electrophotographic characteristics in the same way as in Example 1. As result it exhibited a high charge-retentivity an excellent photosensitivity. Further, as a result of subjecting it to negative charge, image exposure and toner development, there was obtained an excellent toner image.

In addition, a plurality of carbonic film samples were prepared under the same film forming conditions as in the case of forming the foregoing carrier transportation layer for measuring an optical absorption coefficient and a concentration of hydrogen atom contained in the samples.

As a result of conducting various measurements, it could be estimated that the optical absorption coefficient of the carrier transportation layer was $8\times10^3$ cm$^{-1}$ at 2.5 eV and it became decreased as the photon energy decreased. It also could be estimated that the concentration of hydrogen atom contained in the carrier transportation layer was 7 atomic %.

EXAMPLE 11

The procedure of Example 7 were repeated, except that the conditions for forming each of the constituent layers for an electrophotographic member were changed as below mentioned, to thereby prepare an objective electrophotographic photosensitive member. There was used an aluminum circular substrate. Firstly, the air in the deposition chamber 401 was evacuated to bring the film forming space to about $10^{-7}$ Torr, and the substrate was heated to a temperature of 230° C. Then, $CH_4$ gas and $H_2$ gas were fed at flow rates of 0.5 SCCM and 50 SCCM respectively under the inner pressure condition of $3\times10^{-2}$ Torr while microwave discharging. In this case, the other film forming conditions employed were as follows;

| | |
|---|---|
| inner pressure | $3\times10^{-2}$ Torr |
| magnetic field | 500 Gauss |
| microwave power | 400 W |
| substrate bias | 1.5 V |

As a result, a charge injection inhibition layer was deposited in a thickness of 500 Å on the substrate.

Successively, the inner pressure was lowered to $2.4\times10^{-3}$ Torr and the power source of the heater 408 was switched off, to thereby lower the temperature of the substrate to 200° C. Then, switching on the power source of the heater, the temperature of the substrate was maintained at 200° C. Thereafter, a carrier generation layer composed of A-Si:H was deposited in a thickness of 1 μm under the following film forming conditions;

| | |
|---|---|
| magnetic field | 875 Gauss |
| microwave power | 300 W |
| gas used and its flow rate | $SiH_4$ 10 SCCM<br>$H_2$ 50 SCCM |

Further, increasing the temperature of the substrate to 300° C., the carrier transportation lay consistuted with a carbonic film was deposited on the previously formed carrier generation layer under the film forming conditions as follows;

| | |
|---|---|
| microwave power | 450 W |
| magnetic field | 500 Gauss |
| substrate bias | −70 V |
| gas used and its flow rate | $CH_3Br$ 5 SCCM<br>$H_2$ 75 SCCM |

The resultant electrophotographic photosensitive member was set to a conventional experimental electrophotographic machine to examine its electrophotographic characteristics in the same way as in Example 1. As a result, it exhibited a high charge-retentivity and an excellent photosensitivity. Further, as a result of subjecting it to negative charge, image exposure and toner development, there was obtained an excellent toner image.

In addition, a plurality of carbonic film samples were prepared under the same film forming conditions as in the case of forming the foregoing carrier transportation layer for measuring a optical absorption coefficient and a concentration of hydrogen atom contained in the samples.

As a result of conducting various measurements, it could be estimated that the optical absorption coefficient of the carrier transportation layer was about $8\times10^3$cm$^{-1}$ at 2.5 eV and the concentration of hydrogen atom contained in the carrier transportation layer was 5 atomic %.

EXAMPLE 12

There was prepared an electrophotographic photosensitive member having the layer structure shown in FIG. 1 using the fabrication apparatus shown in FIG. 3.

There was used a circular n-type silicon wafer having an electric conductivity of about $10^{-2}\Omega^{-1}$cm$^{-1}$ as the substrate 307.

After an oxide film deposited on the surface of the circular substrate being removed with a diluted solution of fluoric acid, it was attached to the upper electrode 306. The deposition chamber was substantially enclosed, and the air of the film forming space was evacuated by opening the main valve 302' to bring the chamber to a vacuum of about $2\times10^{-7}$ Torr. Then, an AC power of 50 Hz was impressed to the tungsten coil electric heater 308 being so installed as to position along and over the circular substrate 307 in the film forming space A and the heater was heated to about 2500° C. to thereby cause a radiant heat. Using which heat, the circular substrate was heated until the temperature of its reverse side which is not faced to the heater 308 becomes to be about 450° C. measured using a thermocouple (not shown)]. Thereafter, the temperature of the heater 308 was reduced to about 2000° C. to thereby make the temperature of the circular substrate stable.

Then, a DC power was impressed to the metal coil 309 to make the magentic field on the upper inner face part of the circumferential side wall of the deposition chamber to be 800 Gauss.

The switching positions in the alternation circuits C-7 and C-1 were turned to the position a and the polarity of the DC power source C-3 was so adjusted that the circular substrate side became −60 V.

Thereafter, minimizing the mass flow controllers **312*b* and 313*b*, the valves 312*a* and 312*c* for the reservoir 312 in which $CH_4$ being stored and the valves 313*a* and 313*c* for the reservoir 313** in which $F_2$ being stored were opened.

Successively, the mass flow controllers **312*b* and 313*b* were so regulated that the respective flow rates of $CH_4$ gas from the reservoir 312 and $F_2$ gas from the reservoir 313** became 5 SCCM and 60 SCCM. In this event, the inner pressure of the film forming space was $7\times10^{-3}$ Torr.

Then, the power source C-2 was switched on to thereby start discharging under the condition of power supply of 350 W. After 48 hours since the discharge and the inner pressure became stable, the power sources C-2 and C-3 were switched off to stop charging, and the valves **312*c* and 313*c* were closed to stop supplying said gases at the same time. In this way, a carrier transportation layer constituted with a carbonic film of about 8 μm in thickness was deposited on the circular substrate 307**.

Then, after the temperature of the substrate being reduced to 250° C. by adjusting the power source for the heater, the switching positions of the alteration circuits C-1 and C-7 were turned to the position b respectively. Opening the valves **314*a* and 314*c* for the reservoir 314 in which $SiH_4$ gas being stored and the valves 313*a* and 313*c* for the reservoir 315 in which $H_2$ gas being stored, the mass flow controllers 314*b* and 315*b*** were so regulated that the flow rates of $SiH_4$ gas and of $H_2$ gas became 10 SCCM and 90 SCCM respectively.

Then, the power source C-2 was switched on.

As a result, a carrier generation layer composed of A-Si:H of about 1 μm in thickness was deposited on the previously formed carrier transportation layer.

Successively, opening the valve **316*a* and 316*c* for the reservoir 316 in which $C_2H_2$ gas being stored, $C_2H_2$ gas was intermixed in a mixture of $SiH_4$ gas and $H_2$ gas using the mass flow controller 316*b***. As a result, a surface layer composed of A-Si:H:C was deposited in a thickness of 1000 Å on the above carrier generation layer composed of A-Si:H.

After all the constituent layers being continueously deposited in this way, the valves 311 and **312*c* through 316*c* were closed, the power source for the heater 308 was switched off and the circular substrate was sufficiently cooled. Breaking the vacuum of the deposition chamber 301**, the circular substrate having the foregoing deposited layer thereon was taken out therefrom.

The resultant electrophotographic photosensitive member was set to a experimental electrophotographic coping machine to examine its electrophotographic characteristic.

As a result, it exhibited a high charge-retentivity and an excellent photosensitivity.

Further, as a result of subjecting the resultant electrophotographic photosensitive member to negative charge, image exposure and toner development using said coping machine, there was obtained an excellent toner image.

Independently, a plurality of carbonic film samples were prepared under the same film forming conditions as in the case of forming the foregoing carrier transport layer, for measuring an optical band gap, electric conductivity, Raman spectram and the concentration of the hydrogen atom and fluorine atom contained in the carrier transport layer. As a result of measuring, it could be estimated that the optical band gap of the carrier transportation layer is 3.7 eV, and its electric conductivity is $10^{-16}\Omega^{-1}cm^{-1}$. It also could be estimated that the carrier transportation layer contains hydrogen atom and fluorine atom in concentrations of 5 atomic % and 3 atomic % respectively. Further, as a result of measuring the Raman spectrum, there was observed a clear Stokes line in the region containing 1333 $cm^{-1}$.

EXAMPLE 13

The procedures of Example 12 were repeated, except that the conditions for forming the carrier transportation layer were changed to those as below mentioned, to thereby obtain an objective electrophotographic photosensitive member.

| gas used & its flow rate | |
|---|---|
| $CH_3F$ | 10 SCCM |
| $H_2$ | 100 SCCM |
| substrate temperature | 450° C. |
| substrate bias | −70 V |
| heater (filament) temperature | 2400° C. |
| RF power | 300 W |
| magnetic field | 600 Gauss |
| inner pressure | 0.02 Torr |

As results of examining the electrophotographic characteristics of the resultant electrophotographic photosensitive member in the same way as in Example 12, it exhibited a high charge-detentivity and an excellent photosensitivity. Further, as a result of subjecting it to negative charge, image exposure and toner development, there was obtained an excellent toner image.

In addition, a carbonic film sample having only a carrier transportation layer on the Si substrate was prepared under the same film forming conditions as in the case of forming the foregoing carrier transportation layer for measuring chemical composition of the carbonic film.

As a result, it could be estimated that the carrier transportation contains oxygen atom. Further, as a result of measuring the concentration for hydrogen atom and fluorine atom contained in the carbonic film with a infrated absorption spectrum, it could be estimated that the carrier transportation layer contains hydrogen atom and fluorine atom in concentrations of 7 atomic % and 8 atomic % respectively.

Further, a plurality of carbonic film samples of 2 μm in thickness were prepared under the same film forming conditions as in the case of forming the foregoing carrier transportation layer for measuring a optical band gap and a electric conductivity. As a result, it could be estimated that the optical band gap of the carrier transportation layer is 2.8 eV and its electric conductivity in a dry atmosphere is $4\times10^{-14}\Omega^{-1}cm^{-1}$.

EXAMPLE 14

The procedures of Example 12 were repeated, except that the conditions for forming the carrier transportation layer were changed to those as below mentioned, to thereby obtain an objective electrophotographic photosensitive member.

| | | |
|---|---|---|
| gas used and its flow rate | $CF_4$ | 10 SCCM |
| | $H_2$ | 87 SCCM |
| | $NH_3$ | 3 SCCM |
| inner pressure | $7\times10^{-3}$ Torr | |
| RF power | 350 W | |
| substrate bias | −80 V | |
| substrate temperature | 550° C. | |
| magnetic field | 800 Gauss | |

As a result of measuring the samples which were prepared under the same film forming conditions as in the case of forming the foregoing carrier transportation layer for measuring physical properties, it could be estimated that the optical band gap is 3.2 eV and the electric conductivity is $0.5\times10^{-13}\Omega^{-1}cm^{-1}$. It also could be estimated that the carrier transportation layer contains hydrogen atom and fluorine atom in concentrations of 10 atomic % and 12 atomic % respectively, and the oxygen atom is further contained in it.

In addition, the resultant electrophotographic photosensitive member was set to a experimental electrophotographic copying machine in the same way as in Example 1 for examining its electrophotographic characteristic. As a result, it exhibited a high charge-retentivity and an excellent photosensitivity. Further, as a result of subjecting the resultant electrophotographic photosensitive member to positive charge, image exposure and toner development, there was obtained an excellent toner image.

EXAMPLE 15

The procedures of Example 12 were repeated, except that the conditions for forming the carrier transportation layer and the surface layer were changed to those as below mentioned, to thereby obtain an objective electrophotographic photosensitive member.

The conditions for forming the carrier transportation layer were as follows;

| | | |
|---|---|---|
| gas used & its flow rate | $C_2H_4$ | 20 SCCM |
| | $H_2$ | 60 SCCM |
| | $F_2$ | 10 SCCM |
| substrate temperature | 250° C. | |
| substrate bias | 0 V | |
| RF power | 450 W | |
| inner pressure | 0.1 Torr | |

Independently, there was prepared a sample for measuring physical properties under the above conditions for forming the carrier transportation layer.

As a result of measuring the physical properties of the resultant sample, it could be estimated that the optical band gap of the carrier transportation layer is 2.3 eV and its electric conductivity is $2.0\times10^{-13}\Omega^{-1}cm^{-1}$. As a result of examining the chemical composition of the resultant sample, it could be estimated that the carrier transportation layer contains hydrogen atom in a concentration of 12 atomic % and fluorine atom in a concentration of 10 atomic %.

The conditions for forming the surface layer were as follows;

| | | |
|---|---|---|
| gas used & its flow rate | $CH_4$ | 2 SCCM |
| | $H_2$ | 60 SCCM |
| | $F_2$ | 20 SCCM |
| RF power bias | 500 W | |
| substrate bias | −50 V | |
| substrate temperature | 250° C. | |
| inner pressure | 0.01 Torr | |

As a result, the surface layer was deposited in a thickness of 1000 Å.

Independently, there was prepared some samples for examining physical properties and chemical composition, under the above conditions for forming the surface layer.

As a result of examining physical property and chemical composition of the resultant samples, it could be estimated that the electric conductivity of the surface layer is $2.6\times10^{-14}\Omega^{-1}cm^{-1}$ and the layer contains fluorine atom of 2 atomic % in concentration and hydrogen atom of 5 atomic % in concentration.

Further, as a result of examining electrophotographic characteristics on the resultant photosensitive member using a experimental electrophotographic copying machine, it exhibited a high charge-retentivity and an excellent sensitivity. Further, as a result of conducting positive charge, image exposure, toner development and blade cleaning, there was obtained an excellent toner image.

EXAMPLE 16

There was prepared an electrophotographic photosensitive member having the layer structure shown in FIG. 2 using the fabrication apparatus shown in FIG. 5.

In this example, there was used an aluminum cylinder as the substrate 501.

Firstly, the air in the deposition chamber was evacuated to bring the film forming space to about $2\times10^{-7}$ Torr, and the substrate was heated to a temperature of 230° C. Then, $SiH_4$ gas, $H_2$ gas and $B_2H_6$ gas were fed at flow rates of 10 SCCM, 90 SCCM and 0.5 SCCM respectively under the inner pressure condition of about 0.1 Torr while supplying a RF power of 150 W.

As a result, a charge injection inhibition layer composed of A-Si:H containing boron atom (B) in a high concentration was deposited in a thickness of 1000 Å on the substrate.

Successively, regulating the flow rates of $SiH_4$ gas and $B_2H_6$ gas to 0 respectively, only $H_2$ gas was fed for an hour while discharging. Then, $SiH_4$ gas and $H_2$ gas were fed again at flow rates of 10 SDCM and 90 SCCM respectively while discharging. At a result, a carrier generation layer composed of A-Si:H was deposited in a thickness of about 1 μm on the previously formed charge injection inhibition layer.

Thereafter, the feed of $SiH_4$ gas and $H_2$ gas was discontinued, and the air in the deposition chamber was evacuated to bring the film forming space to $4\times10^{-7}$ Torr. Then, a carrier transport layer was deposited in the following way.

That is, $H_2$ gas containing 3 mol % of aceton ($CH_3COCH_3$) was produced using the vaporizer 317, which was successively fed into the deposition chamber at a flow rate of 200 SCCM. Further, $F_2$ gas was fed at a flow rate of 40 SCCM. The other conditions for forming the carrier transport layer were as follows;

| | |
|---|---|
| inner pressure | 0.5 Torr |
| RF power | 450 W |
| substrate bias | −70 V |
| magnetic field | 500 Gauss |

As a result of examining the samples which were prepared for use in chemical analysis under the above conditions for forming the carrier transport layer, it could be estimated that the carrier transportation contains hydrogen atom of 3 atomic % in concentration and fluorine atom of 1 atomic % in concentration.

Further, as a result of subjecting the resultant photosensitive member to image making using a remodeled Canon's electrophotographic copying machine NP 7550 for experimental purposes (product of Canon Kabushiki Kaisha), there was obtained an excellent toner image.

EXAMPLE 17

An electrophotographic photosensitive member having the layer structure shown in FIG. 1 was prepared using the fabrication apparatus shown in FIG. 4 in the following way.

The film forming conditions of a carrier transportation layer employed;

| | | |
|---|---|---|
| gas used and its flow rate | $CH_2F_2$ | 5 SCCM |
| | $H_2$ | 50 SCCM |
| microwave power | 600 W (2.45 GHz) | |
| inner pressure | $7 \times 10^{-4}$ Torr | |
| magnetic field* | 875 Gauss | |

*there was made to cause an electron cyclotron resonance.

Under the above conditions, the position of the parting strip 408 was so adjusted that the deposition chamber 400 could act as a cavity resonator for microwave. The resulting gas plasmas were made to blow through the opening of the parting strip 408 into the film forming space wherein the substrate being placed.

Then, the substrate temperature was controlled to 350° C., and the substrate bias was made to be −150 V.

As a result, a carrier transportation layer constituted with a carbonic film was deposited on the substrate in a thickness of 8.0 μm.

Independently, there was prepared a sample for use in chemical composition analysis under the above conditions for forming the carrier transportation layer.

As a result of examining the chemical composition of the resultant sample, it could be estimated that the carrier transportation layer contains hydrogen atom and fluorine atom in a concentration of about 0.1 atomic % respectively.

Successively, a carrier generation composed of A-S:H was deposited on the foregoing carrier transportation layer in the following way.

That is, switching off the power source for the heater 408, the temperature of the substrate was lowered to 100° C. Then, said power source was again switch on to thereby make the temperature of the substrate maintained stable at 200° C. Thereafter, $SiH_4$ gas and $H_2$ gas were fed at flow rates of 10 SCCM and 50 SCCM respectively under the inner pressure condition of $2.6 \times 10^{-3}$ Torr and the microwave was applied into the magnetic field of 875 Gauss, to thereby obtain a carrier generation layer composed of A-Si:H of about 1 μm in thickness on the previously formed carrier transportation layer.

Repeating the above procedures except that $CH_4$ gas, $SiH_4$ gas and $H_2$ gas were fed at flow rates of 7 SCCM, 3 SCCM and 50 SCCM respectively, a surface layer was deposited on the foregoing carrier generation layer, to thereby obtain an objective electrophotographic photosensitive member.

As a result of examining electrophotographic characteristics on the resultant photosensitive member using a experimental electrophotographic copying machine, it exhibited a high charge-retentivity and an excellent sensitivity. Further, as a result of conducting negative charge, image exposure, toner development, there was obtained an excellent toner image.

EXAMPLE 18

The procedures of Example 12 were repeated, except that the conditions for forming the surface layer were changed to those as below mentioned, to thereby obtain an objective electrophotographic photosensitive member.

| | | |
|---|---|---|
| gas used & its flow rate | $CH_2F_2$ | 5 SCCM |
| | $H_2$ | 100 SCCM |
| $PH_3/H_2$ (10 mol %) | | 0.5 SCCM |
| substrate temperature | 350° C. | |
| substrate bias | −120 V | |
| RF power | 600 W | |
| magnetic field | 400 Gauss | |
| inner pressure | 0.01 Torr | |

The resultant electrophotographic photosensitive member was set to a conventional experimental electrophotographic machine to examine its electrophotographic characteristics in the same way as in Example 12. As a result, it exhibited a high charge-retentivity and an excellent photosensitivity. Further, as a result of subjecting it to image making, there was obtained an excellent tonner image.

In addition, as a result of examining a chemical composition in the same way as in Example 12, it could be estimated that the carrier transportation layer contains hydrogen atom of 5 atomic % in concentration and fluorine atom of 2 atomic % in concentration.

EXAMPLE 19

There was prepared an electrophotographic photosensitive member having the layer structure shown in FIG. 2 in the way similar to Example 16 as below mentioned, using the fabrication apparatus shown in FIG. 5.

In this example, there was used an aluminum cylinder as the substrate 501.

Firstly, the air in the deposition chamber 201 was evacuated to bring the film forming space to about $6 \times 10^{-7}$ Torr, and the substrate was heated to a temperature of 230° C. Then, $SiH_4$ gas, $H_2$ gas and $B_2H_6$ gas were fed at flow rates of 30 SCCM, 180 SCCM and 1.5 SCCM respectively under the inner pressure condition of about 0.1 Torr while supplying a RF power of 500 W.

As a result, a charge injection inhibition layer composed of A-Si:H containing boron atom (B) in a high concentration was deposited in a thickness of 1000 Å on the substrate.

Successively, regulating the flow rates of $SiH_4$ gas and $B_2H_6$ gas to 0 respectively, only $H_2$ gas was fed for an hour while discharging. Then, $SiH_4$ gas and $H_2$ gas were fed again at flow rates of 30 SCCM and 180 SCCM respectively while discharging. At a result, a carrier generation layer composed of A-Si:H was deposited in a thickness of about 1 μm on the previously formed charge injection inhibition layer.

Then, the resultant electrophotographic photosensitive member was set to a remodeled Canon's electrophotographic copying machine NP 7550 for experimental purposes (product of Canon Kabushiki Kaisha) to evaluate its image making function. As a result of subjecting the resultant electrophotographic photosensitive member to positive charge, it exhibited a high charge-retentivity. Further, a result of image making, there was obtained an excellent toner image and the original image quality was maintained even after 1,260,000 shots.

In addition as a result of examining chemical composition in the same way as in Example 16, it could be estimated that the carrier transportation layer contains fluorine atom and hydrogen atom in concentrations of 10 atomic % and 7 atomic % respectively.

COMPARATIVE EXAMPLE 3

There was prepared an electrophotographic photosensitive member having the layer structure shown in FIG. 1 in the same procedures as Example 12, except that the switching positions of the alteration circuits C-1 and C-7 were turned to the position b and the conditions for forming the carrier transport layer were changed as below shown.

| | | |
|---|---|---|
| gas used and its flow rate | $CH_4$ | 30 SCCM |
| | $F_2$ | 70 SCCM |
| inner pressure | 5 Torr | |
| RF power | 250 W | |
| substrate temperature | 200° C. | |
| heater (filament) temperature | 800° C. | |

In this case, the metal coil was not impressed, to thereby make no magnetic field around the substrate.

As a result, the thickness of the resultant carrier transportation layer was 18 μm.

Further, as a result of examining the resultant electrophotographic photosensitive member using a experimental electrophotographic copying machine in the same way as in Example 1, it was confirmed that there was practically problematic in the viewpoint of durability.

COMPARATIVE EXAMPLE 4

There was prepared an electrophotographic photosensitive member in the same procedures as Example 12, except that the conditions for forming the carrier transportation layer were changed as below shown.

| | | |
|---|---|---|
| gas used and its flow rate | $C_2H_4$ | 20 SCCM |
| | $H_2$ | 50 SCCM |
| | $F_2$ | 20 SCCM |
| inner pressure | 0.04 Torr | |
| RF power | 450 W | |
| substrate bias | 0 V | |

In this case, at the beginning of the forming the carrier transportation layer, the temperature of the substrate was adjusted to 450° C., and thereafter the power source of the heater 308 was switched off. Further, the voltage of the DC power source C-3 was adjusted to 0 V, and the switching positions of the alteration circuits C-1 and C-7 were turned to the position a respectively during the forming carrier transportation layer while magnetic field was not utilized.

As a result, the thickness of the resultant carrier transportation layer was 8 μm.

Further, as a result of examining the resultant electrophotographic photosensitive member using an experimental electrophotographic copying machine in the same way as in Example 1, it was confirmed that there was practically problematic.

In addition, as a result of measuring the physical properties in the same way as in Example 12, it could be estimated that the optical band gap of the resultant carrier transportation layer is 1.34 eV and its electric conductivity is $7.8\times10^{-9}\Omega^{-1}cm^{-1}$. It also could be estimated that the carrier transportation layer contains hydrogen atom and fluorine atom in concentrations of 20 atomic % and 17 atomic % respectively.

EXAMPLE 20

There was prepared an electrophotographic photosensitive member having the layer structure shown in FIG. 1 using the fabrication apparatus shown in FIG. 3.

There was used a circular n-type silicon wafer having an electric conductivity of about $10^{-2}\Omega^{-1}cm^{-1}$ as the substrate 307.

After an oxide film deposited on the surface of the circular substrate being removed with a diluted solution of fluoric acid, it was attached to the upper electrode 306. The deposition chamber was substantially enclosed, and the air of the film forming space was evacuated by opening the main valve 302' to bring the chamber to a vacuum of about $2\times10^{-7}$ Torr. Then, an AC power of 50 Hz was impressed to the tungsten coil electric heater 308 being so installed as to position along and over the circular substrate 307 in the film forming space A and the heater was heated to about 2500° C. to thereby cause a radiant heat. Using which heat, the circular substrate was heated until the temperature of its reverse side which is not faced to the heater 308 becomes to be about 450° C. measured using a thermocouple (not shown)]. Thereafter, the temperature of the heater 308 was reduced to about 2000° C. to thereby make the temperature of the circular substrate stable.

Then, a DC power was impressed to the metal coil 309 to make the magnetic field on the upper inner face part of the circumferential side wall of the deposition chamber to be 800 Gauss.

The switching positions in the alteration circuits C-7 and C-1 were turned to the position a and the polarity of the DC power source C-3 was so adjusted that the circular substrate side became −300 V.

Thereafter, minimizing the mass flow controllers **312*b* and 313*b*, the valves 312*a* and 312*c* for the reservoir 312 in which $CH_4$ being stored and the valves 313*a* and 313*c* for the reservoir 313** in which $H_2$ being stored were opened.

Successively, the mass flow controllers **312*b* and 313*b* were so regulated that the respective flow rates of $CH_4$ gas from the reservoir 312 and $H_2$ gas from the reservoir 313** became 5 SCCM and 100 SCCM. In this event, the inner pressure of the film forming space was 0.01 Torr.

Then, the power source C-2 was switched on to thereby start discharging under the condition of power supply of 350 W. After 48 hours since the discharge and the inner pressure became stable, the power sources C-2 and C-3 were switched off to stop charging, and the valves 312*c* and 313*c* were closed to stop supplying said gases at the same time. In this way, a carrier transportation layer constituted with a carbonic film of about 8 μm in thickness was deposited on the circular substrate 307. Then after the temperature of the substrate being reduced to 250° C. by adjusting the power source for the heater, the switching positions of the alteration circuits C-1 and C-7 were turned to the position b respectively.

Opening the valves 314*a* and 314*c* for the reservoir 314 in which $SiH_4$ gas being stored and the valves 313*a* and 313*c* for the reservoir 313 in which $H_2$ gas being stored, the mass flow controllers 314 and 313 were so regulated that the flow rates of $SiH_4$ gas and of $H_2$ gas became 10 SCCM and 90 SCCM respectively.

Then, the power source C-2 was switched on.

As a result, a carrier generation layer composed of A-Si:H of about 1 μm in thickness was deposited on the previously formed carrier transportation layer.

Successively, on the above layer, there was deposited a surface layer under the following film forming conditions;

| | | |
|---|---|---|
| gas used & its flow rate | $CH_4$ | 1 SCCM |
| | $H_2$ | 50 SCCM |
| substrate temperature | 300° C. | |
| substrate bias | −90 V | |
| RF power | 450 W | |

After the above film forming process being completed the corresponding valves were closed, and the power source for the heater was switched off. Then, after the substrate being cooled to room temperature, the vacuum of the deposition chamber was broken and the substrate was taken out from the deposition chamber to thereby obtain an objective electrophotographic photosensitive member of the type shown in FIG. 1 (Sample No. 201).

The above film forming procedures were repeated, except that the flow rate of $CH_4$ in the case of forming the surface layer was changed to 2, 3, 5 and 10 SCCM respectively, to thereby obtain another different four electrophotographic photosensitive members (Samples Nos. 202 through 205).

On each of the five different samples, there was measured a coefficient of kinetic friction by the above described measuring method therefor.

Further, there was examined a cleaning property on each of them by setting it to a experimental electrophotographic copying machine and conducting negative charge, image exposure, toner development, image transfer and blade cleaning successively.

The results obtained are shown in Table 1.

TABLE 1

| Sample No. | 201 | 202 | 203 | 204 | 205 |
|---|---|---|---|---|---|
| Flow rate of $CH_4$ (SCCM) | 1 | 2 | 3 | 5 | 10 |
| Coefficient of kinetic friction | 0.04 | 0.03 | 0.4 | 0.6 | 0.8 |
| Cleaning property* | ◎ | ◎ | ○ | Δ | Δ |
| Hydrogen atom content (%) | 1 | 1 | 10 | 20 | 34 |

◎: excellent,
○: good,
Δ: poor

From the results of Table 1, it can be understood that a satisfactory cleaning property is obtained in the case where the coefficient of kinetic friction is less than 0.5.

EXAMPLE 21

The procedures of Example 20 were repeated, except that the conditions for forming the surface layer were changed to those as below mentioned, to thereby obtain an objective electrophotographic photosensitive member 1.

| | | |
|---|---|---|
| gas used & its flow rate | $CH_3OH$ | 3 SCCM |
| | $H_2$ | 100 SCCM |
| substrate temperature | 300° C. | |
| substrate bias | −100 V | |
| heater (filament) temperature | 2400° C. | |
| RF power | 300 W | |
| magnetic field | 800 Gauss | |
| inner pressure | 0.01 Torr | |

As a result of examining the coefficient of kinetic friction on the resultant photosensitive member in the same way as in Example 20, it was 0.15. And it was also found that the hydrogen atom concentration in the film is 10 atomic %.

Further, as a result of examining electrophotographic characteristics on the resultant photosensitive member using a experimental electrophotographic copying machine, it exhibited a high charge-retentivity and an excellent sensitivity. Further, as a result of conducting negative charge, image exposure, toner development and blade cleaning, there was obtained an excellent toner image, and it was found the photosensitive member excels in the cleaning property.

EXAMPLE 22

The procedures of Example 20 were repeated, except that the conditions for forming the surface layer were changes as below mentioned, to thereby obtain an objective electrophotographic photosensitive member.

| | | |
|---|---|---|
| gas used & its flow rate | ethane | 3 SCCM |
| | hydrogen gas($H_2$) | 87 SCCM |
| | ammonia gas | 3 SCCM |
| inner pressure | 0.01 Torr | |
| substrate temperature | 250° C. | |
| RF power | 350 W | |
| magnetic field | 800 Gauss | |

As a result of measuring the coefficient of kinetic friction on the resultant photosensitive member in the same way as in Example 20, it was 0.2.

Further, as a result of examining electrophotographic characteristics on the resultant photosensitive member using a experimental electrophotographic copying machine, it exhibited a high charge-retentivity and an excellent sensitivity. Further, as a result of conducting negative charge, image exposure, toner development and blade cleaning, there was obtained an excellent toner image, and it was found the photosensitive member excels in the cleaning property.

Independently, there was prepared a sample for use in chemical composition analysis under the above conditions for forming the surface layer.

As a result of examining the chemical composition of the resultant sample, it could be estimated that the surface layer contains hydrogen atom in a concentration of 8 atomic and nitrogen atom.

EXAMPLE 23

The procedures of Example 20 were repeated, except that the conditions for forming the surface layer were changed as below shown, to thereby obtain an objective electrophotographic photosensitive member.

| | | |
|---|---|---|
| gas used & its flow rate | methane | 3 SCCM |
| | hydrogen gas ($H_2$) | 77 SCCM |
| | hydrogen fluoride diluted with $H_2$ (10 mole %) | 3 SCCM |
| RF power | 450 W | |
| substrate bias | −80 V | |
| substrate temperature | 250° C. | |
| magnetic field | 800 Gauss | |
| inner pressure | 0.1 Torr | |

As a result of measuring the coefficient of kinetic friction on the resultant photosensitive member in the same way as in Example 20, it was 0.2.

Further, as a result of examining electrophotographic characteristics on the resultant photosensitive member using a experimental electrophotographic copying machine, it exhibited a high charge-retentivity and an excellent sensitivity. Further, as a result of conducting positive charge, image exposure, toner development, and blade cleaning in the same way as in Example 2, there was obtained an excellent toner image, and it was found the photosensitive member excels in the cleaning property.

Independently, there was prepared a sample for use in chemical composition analysis under the above conditions for forming the surface layer.

From the result of examining the chemical composition of the resultant sample, it could be estimated that the surface layer contains hydrogen atom in a concentration of 8 atomic % and fluorine atom.

EXAMPLE 24

There was prepared an electrophotographic photosensitive member having the layer structure shown in FIG. 2 using the fabrication apparatus shown in FIG. 5.

In this example, there was used an aluminum cylinder as the substrate 501.

Firstly, the air in the deposition chamber was evacuated to bring the film forming space to about $2\times10^{-7}$ Torr, and the substrate was heated to a temperature of 230° C. Then, $SiH_4$ gas, $H_2$ gas and $B_2H_6$ gas were fed at flow rates of 10 SCCM, 90 SCCM and 0.5 SCCM respectively under the inner pressure condition of about 0.1 Torr while supplying a RF power of 150 W.

As a result, a charge injection inhibition layer composed of A-Si:H containing boron atom (B) in a high concentration was deposited in the thickness of 1000 Å on the substrate.

Successively, regulating the flow rates of $SiH_4$ gas and $B_2H_6$ gas to 0 respectively, only $H_2$ gas was fed for an hour while discharging. Then, $SiH_4$ gas and $B_2H_6$ were fed again at flow rates of 10 SCCM and 90 SCCM respectively while discharging. At a result, a carrier generation layer composed of A-Si:H was deposited in the thickness of about 1 μm on the previously formed charge injection inhibition layer.

Thereafter, the feed of $SiH_4$ gas and $H_2$ gas was discontinued, and the air in the deposition chamber was evacuated to bring the film forming space to $4\times10^{-7}$ Torr. Then, a carrier transport layer was deposited in the following way.

That is, $H_2$ gas containing 3 mol % of aceton ($CH_3COCH_3$) was produced using the vaporizer 317, which was successively fed into the deposition chamber.

The other film forming conditions employed in this case were as follows;

| | |
|---|---|
| flow rate | 120 SCCM |
| inner pressure | 0.5 Torr |
| RF power | 450 W |
| substrate bias | −70 V |
| magnetic field | 500 Gauss |

As a result of examining the coefficient of kinetic friction on the resultant photosensitive member in accordance with the foregoing procedures, it was 0.15.

Then, the resultant electrophotographic photosensitive member was set to a remodeled Canon's electrophotographic copying machine NP 7550 for experimental purposes (product of Canon Kabushiki Kaisha) to evaluate its characteristics and functions.

As a result, it was firstly found that the resultant photosensitive member possesses a high charge-retentivity and an excellent sensitivity.

Then, conducting positive charge, image exposure and toner development and blade cleaning, there were repeatedly obtained high quality toner images. It was also found that it excels in the cleaning property.

Further, as a result of conducting chemical composition analysis for the surface layer it was found that it has a concentration of 10 atomic % for hydrogen atom.

EXAMPLE 25

An electrophotographic photosensitive member having the layer structure shown in FIG. 1 was prepared using the fabrication apparatus shown in FIG. 4 in the following way.

The film forming conditions for a carrier transportation layer employed;

| | | |
|---|---|---|
| gas used and its flow rate | methylbromide | 5 SCCM |
| | $H_2$ | 50 SCCM |
| microwave power | 400 W (2.45 GHz) | |
| inner pressure | 0.0007 Torr | |
| magnetic field* | 875 Gauss | |

*there was made so as to cause an electron cyclotron resonance.

Under the above conditions, the position of the parting strip 408 was so adjusted that the deposition chamber 400 could act as a cavity resonator for microwave. The resulting gas plasmas were made to blow through the opening of the parting strip 408 into the film forming space wherein the substrate being placed.

Then, the substrate temperature was controlled to 350° C., and the substrate bias was made to be −150 V.

As a result, a carrier transportation layer constituted with a carbonic film was deposited on the substrate in a thickness of 9.3 μm.

Successively, a carrier generation layer composed of A-Si:H was prepared in the following way. That is, switching off the power source for the heater 408, the temperature of the substrate was lowered to 100° C. The, said power source was again switch on to thereby make the temperature of the substrate maintained stable at 200° C. Thereafter, $SiH_4$ gas and $H_2$ gas were fed at flow rates of 10 SCCM and 50 SCCM respectively under the inner pressure condition of $2.6\times10^{-3}$ Torr, and the microwave was applied into the magnetic field of 875 Gauss to thereby form a carrier generation layer composed of A-Si:H of about 1 μm in thickness on the previously formed carrier transportation layer.

Repeating the above procedures except that $CH_4$ gas, $SiH_4$ gas and $H_2$ gas were fed at flow rates of 7 SCCM, 3 SCCM and 50 SCCM respectively under the conditions of $7\times10^{-3}$ Torr for the inner pressure and of 450 W for the microwave power, a surface layer was deposited on the above carrier generation layer, to thereby obtain an objective electrophotographic photosensitive member.

The resultant electrophotographic photosensitive member was set to a conventional experimental electrophotographic machine to examine its electrophotographic characteristics in the same way as in Example 1. As a result, it was found that it excels in charge-retentivity and also in photosensitivity. And, subjecting it to negative charge, image exposure and tonner development, a high quality toner image could be repeatedly obtained.

In addition, as a result of measuring the physical properties in the same way as in Example 1, it could be estimated that the optical band gap of the resultant carrier transportation layer is more than 3.0 eV and its electric conductivity is $10^{-15}\Omega^{-1}cm^{-1}$. Then, it could be estimated that the resultant carrier transportation layer contains hydrogen atom in a concentration of 3 atomic % and fluorine atom in a slight concentration.

EXAMPLE 26

The procedures of Example 20 were repeated, except that the conditions for forming the surface layer were changed as below mentioned, to thereby obtain an objective electrophotographic photosensitive member.

| | | |
|---|---|---|
| gas used & its flow rate | methyl bromide | 5 SCCM |
| | hydrogen ($H_2$) | 100 SCCM |
| | $PH_3/H_2$ (10 mole %) | 0.5 SCCM |
| inner pressure | 0.3 Torr | |
| substrate temperature | 350° C. | |
| RF power | 400 W | |
| magnetic field | 400 Gauss | |
| substrate bias | −120 V | |

The electrophotographic photosensitive member thus obtained was subjected to the measurement of its coefficient of kinetic friction in accordance with the foregoing procedures. As a result, it was found that the coefficient of kinetic friction is 0.08.

Further, as a result of examining electrophotographic characteristics on the resultant photosensitive member using a experimental electrophotographic copying machine, it exhibited a high charge-retentivity and an excellent sensitivity. Further, as a result of conducting negative charge, image exposure, toner development and blade cleaning, there was obtained an excellent toner image, and it was found the photosensitive member excels in the cleaning property.

In addition, from the result of chemical composition analysis, it could be estimated that the surface layer contains hydrogen atom in a concentration of 10 atomic %.

EXAMPLE 27

There was prepared an electrophotographic photosensitive member having the layer structure shown in FIG. 2 using the fabrication apparatus shown in FIG. 5.

In this example, there was used an aluminum cylinder as the substrate 501.

First, the air in the deposition chamber 301 was evacuated to bring the film forming space to about $6\times10^{-7}$ Torr, and the substrate was heated to a temperature of 230° C. Then, $SiH_4$ gas, $H_2$ gas and $B_2H_6$ gas were fed at flow rates of 30 SCCM, 180 SCCM and 1.5 SCCM respectively under the inner pressure condition of about 0.1 Torr while supplying a RF power of 500 W.

As a result, a charge injection inhibition layer composed of A-Si:H containing boron atom (B) in a high concentration was deposited in the thickness of 1000 Å on the substrate.

Successively, regulating the flow rates of $SiH_4$ gas and $B_2H_6$ gas to 0 respectively, only $H_2$ gas was fed for an hour while discharging. Then, $SiH_4$ gas and $B_2H_6$ gas were fed again at flow rates of 30 SCCM and 180 SCCM respectively while discharging. At a result, a carrier generation layer composed of A-Si:H was deposited in the thickness of about 1 μm on the previously formed charge injection inhibition layer.

Thereafter, the feeds of $SiH_4$ gas and $H_2$ gas were discontinued, and the air in the deposition chamber was evacuated to bring the film forming space to $4\times10^{-7}$ Torr. Then, a carrier transportation layer was deposited in the following way.

That is, a $H_2$ gas containing 3 mole % of aceton ($CH_3COCH_3$) was produced using the vaporizer 317, which was successively fed into the deposition chamber at a flow rate 200 SCCM.

The other film forming conditions employed were as follows;

| | |
|---|---|
| inner pressure | 0.5 Torr |
| RF power | 650 W |
| substrate bias | −110 V |
| magnetic field | 600 Gauss |

The coefficient of kinetic friction of the resultant electrophotographic photosensitive member was measured in accordance with the foregoing procedures and as a result, it was found that it is 0.06.

As for the content of hydrogen atom contained in the surface layer, from the results of chemical composition analysis, it could be estimated that it is 5 atomic %.

Further, as a result of examining its electrophotographic characteristics using Canon's electrophotographic copying machine NP 7550 for experimental purposes (product of Canon Kabushiki Kaisha), it exhibited a high charge-retentivity and an excellent sensitivity.

Further in addition, conducting positive charge, image exposure, toner development and blade cleaning repeatdly in said copying machine, a high quality toner image was repeatedly obtained. And, even after 1,200,000 shots, any change could not be found in its cleaning property.

EXAMPLE 28

There was prepared an electrophotographic photosensitive member having the layer structure shown in FIG. 1 using the fabrication apparatus shown in FIG. 3.

There was used a circular n-type silicon wafer having an electric conductivity of about $10^{-2}\Omega^{-1}cm^{-1}$ as the substrate 307.

After an oxide film deposited on the surface of the circular substrate being removed with a diluted solution of fluoric acid, it was attached to the upper electrode 306. The deposition chamber was substantially enclosed, and the air of the film forming space was evacuated by opening the main valve 302' to bring the chamger to a vaccum of about $2\times10^{-7}$ Torr. Then, an AC power of 50 Hz was impressed to the tungsten coil electric heater 308 being so installed as to position along and over the circular substrate 307 in the film forming space A and the heater was heated to about 2500° C. to thereby cause a radiant heat. Using which heat, the circular substrate was heated until the temperature of its reverse side which is not faced to the heater 308 becomes to be about 450° C. [measured using a thermocouple (not shown]. Thereafter, the temperature of the heater 308 was reduced to about 2000° C. to thereby make the temperature of the circular substrate stable.

Then, a DC power was impressed to the metal coil 309 to make the magnetic field on the upper inner face part of the circumferential side wall of the deposition chamber to be 800 Gauss.

The switching positions in the alteration circuits C-7 and C-1 were turned to the position a and the polarity of the DC power source C-3 was so adjusted that the substrate side became −300 V.

Thereafter, minimizing the mass flow controllers **312*b* and 313*b*, the valves 312*a* and 312*c* for the reservoir 312 in which $CH_4$ being stored and the valves 313*a* and 313*c* for the reservoir 313** in which $H_2$ being stored were opened.

Successively, the mass flow controllers **312*b* and 313*b* were so regulated that the respective flow rates of $CH_4$ gas from the reservoir 313 and $H_2$ gas from the reservoir 313** became 2 SCCM and 100 SCCM respectively. In this event, the inner pressure of the film forming space was 0.01 Torr.

Then, the power source C-2 was switched on to thereby start discharging under the condition of power supply of 350 W. After 48 hours since the discharge and the inner pressure became stable, the power sources C-2 and C-3 were switched off to stop charging, and the valves **312*c* and 313*c*** were closed to stop supplying said gases at the same time.

In this way, a carrier transportation layer constituted with a carbonic film of about 9 μm in thickness was deposited on the circular substrate 307.

Then, after the temperature of the substrate being reduced to 250° C. by adjusting the power source for the heater, the switching positions of the alteration circuits C-1 and C-7 were turned to the position b respectively.

Opening the valves **314*a* and 314*c* for the reservoir 314 in which $SiH_4$ gas being stored and the valves 313*a* and 313*c* for the reservoir 313 in which $H_2$ gas being stored, the mass flow controllers 314*b* and 313*b*** were so regulated that the flow rates of $SiH_4$ gas and of $H_2$ gas became 10 SCCM and 90 SCCM respectively.

Then, the power source C-2 was switched on.

As a result, a carrier generation layer composed of A-SiH of about 1 μm in thickness was deposited on the previously formed carrier transportation layer.

Successively, opening the valve **316*a* and 316*c* for the reservoir 316 in which $C_2H_2$ gas being stored, $C_2H_2$ gas was intermixed in a mixture of $SiH_4$ gas and $H_2$ gas using the mass flow controller 316*b***. As a result, a surface layer composed of A-Si:H:C was deposited in a thickness of 1000 Å on the above carrier generation layer composed of A-Si:H.

After all the constituent layers being continueously deposited in this way, the valves 311 and **312*c* through 316*c* were closed, the power source for the heater 308 was switched off and the circular substrate was sufficiently cooled. Breaking the vacuum of the deposition chamber 301**, the circular substrate having the foregoing deposited layers thereon was taken out therefrom.

The resultant electrophotographic photosensitive member was set to a experimental electrophotographic copying machine to examine its electrophotographic characteristic.

As a result, it was found that it possesses a high photosensitivity.

Further, the resultant electrophotographic photosensitive member was tested by subjecting it to negative charge, image exposure and toner development using said copying machine. As a result, a high quality toner image could be repeatedly obtained.

Independently, there was prepared a carbonic film sample for use in the measurement of a gap state density for the carrier transportation layer under the same film forming conditions for forming the carrier transportation layer in the above case.

From the results of measuring a gap state density on the resultant sample, it could be estimated that the foregoing carrier transportation layer possesses a gap state density of $9\times10^{16}cm^{-3}$.

And, from the results of chemical composition analysis, it could be estimated that the foregoing carrier transportation layer contains hydrogen atom in a concentration of 5 atomic %.

EXAMPLE 29

The procedures of Example 28 were repeated, except that the conditions for forming the surface layer were changed as below mentioned, to thereby obtain an objective electrophotographic photosensitive member.

| | | |
|---|---|---|
| gas used & its flow rate | $CH_3OH$ | 2 SCCM |
| | $H_2$ | 100 SCCM |
| heater (filament) temperature | 2000° C. | |
| substrate temperature | 350° C. | |
| substrate bias | −100 V | |
| RF power | 300 W | |
| inner pressure | 0.008 Torr | |

Firstly, the electrophotographic characteristics of the resultant photosensitive member were examined in the same way as in Example 28.

As a result, it was found that it possesses a high charge-retentivity and an excellent sensitivity.

Further, as a result of testing the resultant photosensitive member by subjecting it to negative discharge, image exposure and toner development, it was found that a high quality toner image can be stably obtained even upon repeating use for a long period of time.

Independently, there was deposited a carbonic film on a Si-wafer under the above conditions for forming the surface layer, which was engaged in chemical composition analysis. As a result, it could be estimated that the foregoing surface layer contains hydrogen atom in a concentration of 10 atomic % and also contains oxygen atom.

In addition, it could be estimated that the surface layer possesses a gap state density of $3\times10^{17}cm^{-3}$.

EXAMPLE 30

The procedures of Example 28 were repeated, except that the conditions for forming the carrier transportation layer were changes as below mentioned, to thereby obtain an objective electrophotographic photosensitive member.

| | | |
|---|---|---|
| gas used & its flow rate | $C_2H_6$ | 10 SCCM |
| | $H_2$ | 87 SCCM |
| | $NH_3$ | 3 SCCM |
| inner pressure | $8\times10^{-3}$ Torr | |
| substrate temperature | 400° C. | |
| RF power | 350 W | |
| magnetic field | 800 Gauss | |

Independently, there was prepared a carbonic film sample for experimental purposes under the above-mentioned conditions.

And, from the results of various evaluations on the resultant sample, it could be estimated that the carrier transportation layer of the above resultant photosensitive member possesses a gap state density of $1.3\times10^{17}cm^{-3}$ and contains hydrogen atom in a concentration of 7 atomic % and also nitrogen atom.

Further, said photosensitive member was tested using a experimental electrophotographic copying machine. As a result, it was found that the resultant photosensitive member possesses a high charge-retentivity and an excellent sensitivity. Further, it was found that it always gives a high quality toner image.

EXAMPLE 31

The procedures of Example 28 were repeated, except that the conditions for forming the carrier generation layer were changed as below mentioned, to thereby obtain an objective electrophotographic photosensitive member.

| | | |
|---|---|---|
| gas used & its flow rate | $C_2H_4$ | 5 SCCM |
| | $H_2$ | 77 SCCM |
| | $HF/H_2$ (10 mole %) | 3 SCCM |
| substrate temperature | 350° C. | |
| substrate bias | −70 V | |
| RF power | 450 W | |
| inner pressure | $1\times10^{-2}$ Torr | |
| magnetic field | 800 Gauss | |

Firstly, the electrophotographic characteristics of the resultant photosensitive member were examined in the same way as in Example 28.

As a result, it was found that it possesses a high charge-retentivity and an excellent sensitivity.

Further, as a result of testing the resultant photosensitive member by subjecting it to negative discharge, image exposure and toner development, it was found that a high quality toner image can be stably obtained even upon repeating use for a long period of time.

Independently, there was deposited a carbonic film on a Si-wafer under the above conditions for forming the surface layer, which was engaged in chemical composition analysis. As a result, it could be estimated that the foregoing carrier generation layer contains hydrogen atom in a concentration of 7 atomic % and also contains fluorine atom.

In addition, it could be estimated that the surface layer possesses a gap state density of $9\times10^{16}cm^{-3}$.

EXAMPLE 32

There was prepared an electrophotographic photosensitive member having the layer structure shown in FIG. 2 using the fabrication apparatus shown in FIG. 5.

In this example, there was used an aluminum cylinder as the substrate 501.

Firstly, the air in the deposition chamber 201 was evacuated to bring the film forming space to about $2\times10^{-7}$ Torr, and the substrate was heated to a temperature of 230° C. Then, $SiH_4$ gas, $H_2$ gas and $B_2H_6$ gas were fed at flow rates of 10 SCCM, 90 SCCM and 0.5 SCCM respectively under the inner pressure condition of about 0.1 Torr while supplying a RF power of 150 W.

As a result, a charge injection inhibition layer composed of A-Si:H containing boron atom (B) in a high concentration was deposited in the thickness of about 1000 Å on the substrate.

Successively, regulating the flow rates of $SiH_4$ gas and $B_2H_6$ gas to 0 respectively, only $H_2$ gas was fed for an hour while discharging. Then, $SiH_4$ gas and $H_2$ gas were fed again at flow rates of 30 SCCM and 180 SCCM respectively while discharging. At a result, a carrier generation layer composed of A-Si:H was deposited in the thickness of about 1 μm on the previously formed charge injection inhibition layer.

Thereafter, the feeds of $SiH_4$ gas and $H_2$ gas were discontinued, and the air in the deposition chamber was evacuated to bring the film forming space to $4\times10^{-7}$ Torr. Then, a carrier transportation layer was deposited in the following way. That is, $H_2$ gas containing 3 mole % of aceton ($CH_3COCH_3$) was produced using the vaporizer 317, which was successively fed into the deposition chamber at a flow rate of 120 SCCM.

The other film forming conditions employed were as follows;

| | |
|---|---|
| inner pressure | 0.4 Torr |
| substrate temperature | 270° C. |
| RF power | 450 W |
| substrate bias | −70 V |
| magnetic field | 500 Gauss |

As a result of examining its electrophotographic characteristics using Canon's electrophotographic copying machine NP 7550 for experimental purposes (product of Canon Kabushiki Kaisha), it exhibited a high charge-retentivity and an excellent sensitivity.

Further in addition, conducting positive charge, image exposure, toner development and blade cleaning repeatedly in said copying machine, a high quality toner image was repeatedly obtained. And, even after 1,200,000 shots, any change could not be found in its cleaning property.

Independently, there was prepared a carbonic film sample for experimental purposes under the above-mentioned conditions for forming the carrier transportation layer.

And, from the results of various evaluations on the resultant sample, it could be estimated that the carrier transportation layer of the above resultant photosensitive member possesses a gap state density of $1.2\times10^{17}cm^{-3}$ and contains hydrogen atom in a concentration of 18 atomic %.

EXAMPLE 33

An electrophotographic photosensitive member having the layer structure shown in FIG. 1 was prepared using the fabrication apparatus shown in FIG. 4 in the following way.

The employed film forming conditions for a carrier transportation layer;

| | | |
|---|---|---|
| gas used and its flow rate: | methylbromide | 2 SCCM |
| | $H_2$ | 50 SCCM |
| microwave power | 400 W (2.45 GHz) | |
| inner pressure | $7 \times 10^{-4}$ Torr | |
| magnetic field* | 875 Gauss | |

*there was made so as to cause an electron cyclotron resonance.

Under the above conditions, the position of the parting strip 408 was so adjusted that the deposition chamber 400 could act as a cavity resonator for microwave. The resulting gas plasmas were made to blow through the opening of the parting strip 408 into the film forming space wherein the substrate being placed.

Then, the substrate temperature was controlled to 350° C., and the substrate bias was made to be −150 V.

As a result, a carrier transportation layer constituted with a carbonic film was deposited on the substrate in the thickness of 9.3 μm.

Successively, a carrier generation layer composed of A-Si:H was formed in the following way. That is, switching off the power source for the heater 408, the temperature of the substrate was lowered to 100° C. Then, said power source was again switch on to thereby make the temperature of the substrate maintained stable at 200° C. Then, $SiH_4$ gas and $H_2$ gas were fed at flow rates of 10 SCCM and 40 SCCM respectively under the inner pressure condition of $9 \times 10^{-4}$ Torr, and the microwave was applied into the magnetic field of 875 Gauss, whereby form a carrier generation layer composed of A-Si:H of about 1 μm in thickness on the previously formed carrier transportation layer.

Repeating the above procedures except that $CH_4$ gas, $SiH_4$ gas and $H_2$ gas were fed at flow rates of 7 SCCM, 3 SCCM and 50 SCCM respectively under the conditions of $7 \times 10^{-3}$ Torr for the inner pressure and of 400 W for the microwave power, a surface layer was deposited on the above carrier generation layer, to thereby obtain an objective electrophotographic photosensitive member.

The resultant electrophotographic photosensitive member was set to a conventional experimental electrophotographic machine to examine its electrophotographic characteristics in the same way as in Example 1. As a result, it was found that it excels in the charge-retentivity and also in the photosensitivity. And subjecting it to negative charge, image exposure and toner development, a high quality toner image could be repeatedly obtained.

In addition, as a result of measuring the physical properties in the same way as in Example 1, it could be estimated that the gap state density of the resultant carrier transportation layer is $6 \times 10^{16} cm^{-3}$, and it could be also estimated that the resultant carrier transportation layer contains hydrogen atom in a concentration of 4 atomic % and fluorine atom in a slight concentration.

EXAMPLE 34

The procedures of Example 28 were repeated, except that the conditions for forming the carrier transportation layer were changes as below mentioned, to thereby obtain an objective electrophotographic photosensitive member.

| | | |
|---|---|---|
| gas used & its flow rate: | $CH_3Br$ | 5 SCCM |
| | $H_2$ | 100 SCCM |
| | $PH_3/H_2$ (10 mole %) | 0.5 SCCM |
| inner pressure | 0.3 Torr | |
| substrate temperature | 350° C. | |
| RF power | 600 W | |
| magnetic field | 400 Gauss | |
| substrate bias | −70 V | |

Independently, there was prepared a carbonic film sample for experimental purposes under the above-mentioned conditions.

And, from the results of various evaluations on the resultant sample, it could be estimated that the carrier transportation layer of the above resultant photosensitive member possesses a gap state density of $1.4 \times 10^{17} cm^{-3}$ and contains hydrogen atom in a concentration of 10 atomic %.

Further, said photosensitive member was tested using a experimental electrophotographic copying machine. As a result, it was found that the resultant photosensitive member possesses a high charge-retentivity and an excellent sensitivity. Further, it was found that it always gives a high quality toner image.

EXAMPLE 35

There was prepared an electrophotographic photosensitive member having the layer structure shown in FIG. 2 using the fabrication apparatus shown in FIG. 5.

In this example, there was used an aluminum cylinder as the substrate 501.

Firstly, the air in the deposition chamber was evacuated to bring the film forming space to about $2 \times 10^{-7}$ Torr. The substrate was heated to a temperature of 230° C. Then, $SiH_4$ gas, $H_2$ gas and $B_2H_6$ gas were fed at flow rates of 30 SCCM, 180 SCCM and 1.5 SCCM respectively under the inner pressure condition of about 0.1 Torr while supplying a RF power of 500 W.

As a result, a charge injection inhibition layer composed of A-Si:H containing boron atom (B) in a high concentration was deposited thickness of 1000 Å on the substrate.

Successively, regulating the flow rates of $SiH_4$ gas and $B_2H_6$ gas to 0 respectively, only $H_2$ gas was fed for an hour while discharging. Then, $SiH_4$ gas and $H_2$ gas were fed again at flow rates of 30 SCCM and 180 SCCM respectively while discharging. At a result, a carrier generation layer composed of A-Si:H was deposited in the thickness of about 1 μm on the previously formed charge injection inhibition layer.

Thereafter, the feed of $SiH_4$ gas and $H_2$ was discontinued, and the air in the deposition chamber was evacuated to bring the film forming space to $4 \times 10^{-7}$ Torr. Then, a carrier transport layer was deposited in the following way. That is, $H_2$ gas containing 3 mol % of aceton ($CH_3COCH_3$) was produced using the vaporizer 317, which was successively fed into the deposition chamber at a flow rate of 300 SCCM.

The other film forming conditions employed were as follows;

| | |
|---|---|
| inner pressure | 0.7 Torr |
| substrate temperature | 350° C. |

-continued

| | |
|---|---|
| RF power | 650 W |
| substrate bias | −100 V |
| magnetic field | 600 Gauss |

As a result of examining its electrophotographic characteristics using Canon's electrophotographic copying machine NP 7550 for experimental purposes (product of Canon Kabushiki Kaisha), it exhibited a high charge-retentivity and an excellent sensitivity.

Further in addition, conducting positive charge, image exposure, toner development and blade cleaning repeatedly in said copying machine, a high quality toner image was repeatedly obtained. And, even after 1,200,000 shots, any change could not be found in its cleaning property.

Independently, there was prepared a carbonic film sample for experimental purposes under the above-mentioned conditions for forming the carrier transportation layer.

And, from the results of various evaluations on the resultant sample, it could be estimated that the carrier transportation layer of the above resultant photosensitive member possesses a gap state density of $7\times10^{16}$ $cm^{-3}$ and contains hydrogen atom in a concentration of 7 atomic %.

EXAMPLE 36

There was prepared an electrophotographic photosensitive member having the layer structure shown in FIG. 1 using the fabrication apparatus shown in FIG. 3.

There was used a circular p-type silicon wafer having an electric conductivity of about $10^{-2}\Omega^{-1}cm^{-1}$ as the substrate 307.

After an oxide film deposited on the surface of the circular substrate being removed with a diluted solution of fluoric acid, it was attached to the upper electrode 306. The deposition chamber was substantially enclosed, and the air of the film forming space was evacuated by opening the main valve 302' to bring the chamber to a vacuum of about $2\times10^{-7}$ Torr. Then, an AC power of 50 Hz was impressed to the tungsten coil electric heater 308 being so installed as to position along and over the circular substrate 307 in the film forming space A and the heater was heated to about 2500° C. to thereby cause a radiant heat. Using which heat, the circular substrate was heated while being rotated until the temperature of its reverse side which is not faced to the heater 308 becomes to be about 600° C. [measured using a thermocouple (not shown)]. Thereafter, the temperature of the heater 308 was reduced to about 2000° C. to thereby make the temperature of the circular substrate maintained stable at 600° C.

Then, a DC power was impressed to the metal coil 309 to make the magnetic field on the upper inner face part of the circumferential side wall of the deposition chamber to be 800 Gauss.

The switching positions in the alteration circuits C-7 and C-1 were turned to the position a and the polarity of the DC power source C-3 was so adjusted that the cylindrical substrate side became −300 V.

Thereafter, minimizing the mass flow controllers **312*b* and 313*b*, the valves 312*a* and 312*c* for the reservoir 312 in which $CH_4$ being stored and the valves 313*a* and 313*c* for the reservoir 313** in which $H_2$ being stored were opened.

Successively, the mass flow controllers **312*b* and 313*b* were so regulated that the respective flow rates of $CH_4$ gas from the reservoir 312 and $H_2$ gas from the reservoir 313** became 1 SCCM and 100 SCCM respectively. In this event, Torr.

Then, the power source C-2 was switched on to thereby start dischargingnder the condition of power supply of 350 W. After 48 hours since the discharge and the inner pressure became stable, the power sources C-2 and C-3 were switched off to stop charging, and the valves **312*c* and 313*c*** were closed to stop supplying said gases at the same time.

In this way, a carrier transportation layer constituted with a carbonic film of about 8 μm in thickness was deposited on the circular substrate 307.

Then, after the temperature of the substrate being reduced to 250° C. by adjusting the power source for the heater, the switching positions of the alteration circuits C-1 and C-7 were turned to the position b respectively. Opening the valves **314*a* and 314*c* for the reservoir 314 in which $SiH_4$ gas being stored and the valves 313*a* and 313*c* for the reservoir 313 in which $H_2$ gas being stored, the mass flow controllers 314*b* and 313*b*** were so regulated that the flow rates of $SiH_4$ gas and of $H_2$ gas become 10 SCCM and 90 SCCM respectively.

Then, the power source C-2 was switched on.

As a result, a carrier generation layer composed of A-SiH for about 1 μm in thickness was deposited on the previously formed carrier transportation layer.

In addition, opening the valve **316*a* and 316*c* for the reservoir 316 in which $C_2H_2$ gas being stored, $C_2H_2$ gas was intermixed in a mixture of $SiH_4$ gas and $H_2$ gas using the mass flow controller 316*b***. As a result, a surface layer composed of A-Si:H:C was deposited in the thickness of 1000 Å on the above carrier generation layer composed of A-Si:H.

After all the constituent layers being continueously deposited in this way, the valves 311 and **312*c* through 316*c* were closed, the power source for the heater 308 was switched off and the circular substrate was sufficiently cooled. Breaking the vacuum of the deposition chamber 301**, the circular substrate having the foregoing deposited layers thereon was taken out therefrom.

The resultant electrophotographic photosensitive member was set to an experimental electrophotographic copying machine to examine its electrophotographic characteristic.

As a result, it was found that it possesses high charge-retentivity and a high photosensitivity.

Further, the resultant electrophotographic photosensitive member was tested by subjecting it to negative charge, image exposure and toner development using said copying machine. As a result, a high quality toner image could be repeatedly obtained. A plurality of carbonic film samples were prepared under the same film forming conditions as in the case of forming the foregoing carrier transport layer, for measuring an optical band gap, electric conductivity, Raman spectram and the concentration of the hydrogen atom contained in the carrier transport layer. The results of these measurements came to find that the optical band gap of the carrier transport layer is 3.5 eV, its electric conductivity is $10^{-15}\Omega^{-1}cm^{-1}$, and the concentration for the hydrogen atom is 5 atomic %. Further, as a result of measuring the Raman spectrum, there was observed a clear Stokes line in the region containing 1333 $cm^{-1}$.

EXAMPLE 37

The procedures of Example 36 were repeated, except that the conditions for forming the carrier transportation layer were changes as below mentioned, to thereby obtain an objective electrophotographic photosensitive member.

| | | |
|---|---|---|
| gas used & its flow rate | $CH_3OH$ | 1 SCCM |
| | $H_2$ | 100 SCCM |
| substrate temperature | 600° C. | |
| substrate bias | −100 V | |
| heater (filament) temperature | 2400° C. | |
| RF power | 300 W | |
| inner pressure | $2 \times 10^{-3}$ Torr | |

As a result of examining electrophotographic characteristics on the resultant photosensitive member using a experimental electrophotographic copying machine, it exhibited a high charge-retentivity and an excellent sensitivity.

Further, as a result of conducting image making tests by subjecting it to negative charge, image exposure and toner development using the above copying machine, a high quality toner image could be repeatedly obtained.

Independently, there was formed a carbonic sample film on a Si-wafer substrate under the above-mentioned conditions for forming the carrier transportation layer. The resultant sample was engaged in chemical composition analysis by means of infrared spectrophotometry. As a result, it was found that it contains hydrogen atom in a concentration of 11 atomic % and it contains oxygen atom also.

For purposes of measuring an optical band gap and an electric conductivity, another sample having a carbonic layer of 2 μm in thickness on a substrate was prepared under the above-mentioned conditions for forming the carrier transportation layer. Likewise, there was prepared a TEM sample for measuring a diamond phase.

From the results of subjecting said samples to the respective measurements, it was found that it possesses an optical band gap of 2.8 eV and an electric conductivity of $4 \times 10^{-14} \Omega^{-1} cm^{-1}$ under dry environment. And it was also found that the volume ratio of a diamond phase is 85%.

EXAMPLE 38

The procedures of Example 36 were repeated, except that the conditions for forming the carrier transportation layer were changed as below mentioned, to thereby obtain an objective electrophotographic photosensitive member.

| | | |
|---|---|---|
| gas used & its flow rate | $C_2H_5$ | 1 SCCM |
| | $H_2$ | 87 SCCM |
| | $NH_3$ | 3 SCCM |
| inner pressure | $2 \times 10^{-3}$ | |
| RF power | 350 W | |
| substrate temperature | 650° C. | |
| magnetic field | 800 Gauss | |

As a result of examining electrophotographic characteristics on the resultant photosensitive member using a experimental electrophotographic copying machine, it exhibited a high charge-retentivity and an excellent sensitivity.

Further, as a result of conducting image making tests by subjecting it to positive charge, image exposure and toner development using the above copying machine, a high quality toner image could be repeatedly obtained.

Independently, there was formed a carbonic sample film on a Si-wafer substrate under the above-mentioned conditions for forming the carrier transportation layer. The resultant sample was engaged in chemical composition analysis by means of infrared spectrophotometry. As a result, it was found that it contains hydrogen atom in a concentration of 7 atomic % and it contains nitrogen atom also.

For purposes of measuring an optical band gap and an electric conductivity, another sample having a carbonic layer of 2 μm in thickness on a substrate was prepared under the above-mentioned conditions for forming the carrier transportation layer. Likewise, there was prepared a TEM sample for measuring a diamond phase.

From the results of subjecting said samples to the respective measurements, it was found that it possesses an optical band gap of 3.1 eV and an electric conductivity of $1 \times 10^{-13} \Omega^{-1} cm^{-1}$ under dry environment. And it was also found that the volume ratio of a diamond phase is 65%.

EXAMPLE 39

The procedures of Example 36 were repeated, except that the conditions for forming the carrier transportation layer were changes as below mentioned, to thereby obtain an objective electrophotographic photosensitive member.

| | | |
|---|---|---|
| gas used & its flow rate | $CH_4$ | 5 SCCM |
| | $H_2$ | 77 SCCM |
| | $HF/H_2$ (10 mole %) | 3 SCCM |
| substrate temperature | 550° C. | |
| substrate bias | 0 V | |
| RF power | 450 W | |
| inner pressure | 0.01 Torr | |

As a result of examining electrophotographic characteristics on the resultant photosensitive member using a experimental electrophotographic copying machine, it exhibited a high charge-retentivity and an excellent sensitivity.

Further, as a result of conducting image making tests by subjecting it to negative charge, image exposure and toner development using the above copying machine, a high quality toner image could be repeatedly obtained.

Independently, there was formed a carbonic sample film on a Si-wafer substrate under the above-mentioned conditions for forming the carrier transportation layer. The resultant sample was engaged in chemical composition analysis by means of infrared spectrophotometry. As a result, it was found that it contains hydrogen atom in a concentration of 11 atomic % and it contains fluorine atom also.

For purposes of measuring an optical band gap and an electric conductivity, another sample having a carbonic layer of 2 μm in thickness on a substrate was prepared under the above-mentioned conditions for forming the carrier transportation layer. Likewise, there was prepared a TEM sample for measuring a diamond phase.

From the results of subjecting said samples to the respective measurements, it was found that it possesses an optical band gap of 2.3 eV and an electric conductivity of $3.8 \times 10^{-13} \Omega^{-1} cm^{-1}$ under dry environment. And it was also found that the volume ratio of a diamond phase is 50%.

EXAMPLE 40

The procedures of Example 36 were repeated, except that the conditions for forming the carrier transportation layer were changes as below mentioned, to thereby obtain an objective electrophotographic photosensitive member.

| | | |
|---|---|---|
| gas used & its flow rate | $CH_4$ | 1 SCCM |
| | $H_2$ | 100 SCCM |
| | $B_2H_6/H_2$ (1 mole %) | 0.5 SCCM |
| substrate temperature | 600° C. | |
| substrate bias | −100 V | |
| RF power | 250 W | |
| inner pressure | $6 \times 10^{-2}$ Torr | |

As a result of examining electrophotographic characteristics on the resultant photosensitive member using an experimental electrophotographic copying machine, it exhibited a high charge-retentivity and an excellent sensitivity.

Further, as a result of conducting image making tests by subjecting it to negative charge, image exposure and toner development using the above copying machine, a high quality toner image could be repeatedly obtained.

Independently, there was formed a carbonic sample film on a Si-wafer substrate under the above-mentioned conditions for forming the carrier transportation layer. The resultant sample was engaged in chemical composition analysis by means of infrared spectrophotometry. As a result, it was found that it contains hydrogen atom in a concentration of 9 atomic %.

For purposes of measuring an optical band gap and an electric conductivity another sample having a carbonic layer of 2 μm in thickness on a substrate was prepared under the above-mentioned conditions for forming the carrier transportation layer. Likewise, there was prepared a TEM sample for measuring a diamond phase.

From the results of subjecting said samples to the respective measurements, it was found that it possesses an optical band gap of 3.2 eV and an electric conductivity of $4 \times 10^{-12} \Omega^{-1} cm^{-1}$ under dry environment. And it was also found that the volume ratio of a diamond phase is 65%.

EXAMPLE 41

There was prepared an electrophotographic photosensitive member having the layer structure shown in FIG. 2 using the fabrication apparatus shown in FIG. 4.

In this example, a Mo-plate was used as the substrate 408.

After the substrate being chemically grounded, it was attached onto the lower electrode 404.

The air of the film forming space A was evacuated by operating the main valve 402' to bring the deposition chamber 400 to a vacuum of $10^{-7}$ mm Hg. At the same time, the heater 406 was actuated to heat the Mo-substrate to 300° C. And, opening the valves 411*a*, 411*c* and 410' $H_2$ gas from the reservoir 411 was fed into the deposition chamber 400 at a flow rate of 200 SCCM by adjusting the mass flow controller 411*b* property.

The microwave power source 419 was switched on to supply a microwave power of 300 W (2.45 GHz), and at the same time, a DC power was impressed to the metal coil 418 so as to generate a magnetic field of 875 Gauss in the center of the deposition chamber 400 and because of this, $H_2$ gas plasmas formed irradiated toward the surface of the Mo-substrate. After this state being maintained for 30 minutes, $C_2H_2$ gas from the reservoir 412 and silane gas from the reservoir 413 were fed into the deposition chamber 400 to thereby form a layer composed of A-SiC:H in the thickness of about 1000 Å on the Mo-substrate. Thereafter, discontinuing the feed of $C_2H_2$ gas, a layer composed of A-Si:H of about 1 μm in thickness was formed on the previously formed layer.

Then, discontinuing the feed of silane gas and raising the substrate temperature to 700° C., $CH_4$ gas from the reservoir 414 was fed into the reaction chamber 400 at a flow rate of 2 SCCM, wherein the heater 408 (W-filament) maintained at about 2500° C. and the substrate bias was made to be −125 V operating the DC power source 417. In this way, there was formed a carbonic film layer containing a diamond phase in a large quantity of 10 μm on the above A-Si:H layer.

As a result of examining electrophotographic characteristics on the resultant photosensitive member using an experimental electrophotographic copying machine, it exhibited a high charge-retentivity and an excellent sensitivity.

Further, as a result of conducting image making tests by subjecting it to negative charge, image exposure and toner development using the above copying machine, a high quality toner image could be repeatedly obtained.

Independently, there was formed a carbonic sample film on a Si-wafer substrate under the above-mentioned conditions for forming the last layer (the carrier transportation layer). The resultant sample was engaged in chemical composition analysis by means of infrared spectrophotometry. As a result, it was found that it contains hydrogen atom in a concentration of 1 atomic %.

For purposes of measuring an optical band gap and an electric conductivity, another sample having a carbonic layer of 2 μm in thickness on a substrate was prepared under the above-mentioned conditions for forming the carrier transportation layer. Likewise, there was prepared a TEM sample for measuring a diamond phase.

From the results of subjecting said samples to the respective measurements, it was found that it possesses an optical band gap of 2.7 eV and an electric conductivity of $1 \times 10^{-11} \Omega^{-1} cm^{-1}$ under dry environment. And it was also found that the volume ratio of a diamond phase is 60%.

EXAMPLE 42

The procedures of Example 36 were repeated, except that the conditions for forming the carrier transportation layer were changes as below mentioned, to thereby obtain an objective electrophotographic photosensitive member.

| | | |
|---|---|---|
| gas used & its flow rate | $CH_3Br$ | 1 SCCM |
| | $H_2$ | 100 SCCM |
| | $PH_3/H_2$ (10 mole %) | 0.5 SCCM |
| substrate temperature | 600° C. | |
| substrate bias | −200 V | |
| RF power | 600 W | |
| inner pressure | 0.3 Torr | |
| magnetic field | 400 Gauss | |

As a result of examining electrophotographic characteristics on the resultant photosensitive member using an experimental electrophotographic copying machine, it exhibited a high charge-retentivity and an excellent sensitivity.

Further, as a result of conducting image making tests by subjecting it to negative charge, image exposure, and toner development using the above copying machine, a high quality toner image could be repeatedly obtained.

Independently, there was formed a carbonic sample film on a Si-wafer substrate under the above-mentioned conditions for forming the carrier transportation layer. The resultant sample was engaged in chemical composition analysis by means of infrared spectrophotometry. As a result, it was found that it contains hydrogen atom in a concentration of 30 atomic %. And it was also found that the volume ratio of a diamond phase is 80%.

EXAMPLE 43

There was prepared an electrophotographic photosensitive member having the layer structure shown in FIG. 2 using the fabrication apparatus shown in FIG. 5.

In this example, there was used an aluminum cylinder as the substrate 501.

Firstly, the air in the deposition chamber was evacuated to bring the film forming space to about $2\times10^{-7}$ Torr. The substrate was heated to a temperature of 230° C. Then $SiH_4$ gas, $H_2$ gas and $B_2H_6$ gas were fed at flow rates of 30 SCCM, 180 SCCM and 1.5 SCCM respectively under the inner pressure condition of about 0.1 Torr while supplying a RF power of 500 W.

As a result, a charge injection inhibition layer composed of a p-type A-Si:H containing boron atom (B) in a high concentration was deposited in the thickness of 1000 Å on the substrate.

Successively, regulating the flow rates of $SiH_4$ gas and $B_2H_6$ gas to 0 respectively, only $H_2$ gas was fed for an hour while discharging. Then, $SiH_4$ gas and $H_2$ gas were fed again at flow rates of 30 SCCM and 180 SCCM respectively while discharging. At a result, a carrier generation layer composed of A-Si:H was deposited in the thickness of about 1 μm on the previously formed charge injection inhibition layer.

Thereafter, the feed of $SiH_4$ gas and $H_2$ gas was discontinued, and the air in the deposition chamber was evacuated to bring the film forming space to $4\times10^{-7}$ Torr. Then, a carrier transport layer was deposited in the following way. That is, $H_2$ gas containing 3 mol % of aceton ($CH_3COCH_3$) was produced using the vaporizer 317, which was successively fed into the deposition chamber at a flow rate of 300 SCCM.

The other film forming conditions employed were as follows;

| | |
|---|---|
| inner pressure | 0.7 Torr |
| RF power | 650 W |
| substrate bias | −100 V |
| magnetic field | 600 Gauss |

As a result of examining its electrophotographic characteristics using Canon's electrophotographic copying machine NP 7550 for experimental purposes (product of Canon Kabushiki Kaisha), it exhibited a high charge-retentivity and an excellent sensitivity.

Further in addition, conducting positive charge, image exposure, toner development and blade cleaning repeatedly in said copying machine, a high quality toner image was repeatedly obtained. And, even after 1,200,000 shots, any change could not be found in its cleaning property.

Independently, there was prepared a carbonic film sample for experimental purposes under the above-mentioned conditions for forming the carrier transportation layer.

And, from the results of various evaluations on the resultant sample, it could be estimated that the carrier transportation layer of the above resultant photosensitive member contains hydrogen atom in a concentration of 7 atomic % and contains a volume ratio of 90% for the diamond phase.

EXAMPLE 44

Using the fabrication apparatus shown in FIG. 3, there was prepared an objective electrophotographic photosensitive member under the conditions shown in Table 2.

In this example, there was used a circular plate of p-type silicon wafer as the substrate 307.

TABLE 2

| Layer & thickness | Gas used Flow rate | | Film forming conditions | |
|---|---|---|---|---|
| Carrier transportation layer (10 μm) | $CH_4$ | 5 SCCM | inner pressure | $4\times10^{-3}$ Torr |
| | $H_2$ | 200 SCCM | substrate temperature | 500° C. |
| | | | magnetic field | 800 Gauss |
| | | | substrate bias | −250 V |
| | | | RF power | 250 W |
| Carrier generation layer (1 μm) | $SiH_4$ | 10 SCCM | inner pressure | $2\times10^{-3}$ Torr |
| | $H_2$ | 100 SCCM | substrate temperature | 250° C. |
| | | | substrate bias | +250 V |
| | | | Others are the same as the above | |
| Surface (0.1 μm) | $C_2H_2$ | 20 SCCM | The same as in the case of carrier transportation layer | |
| | $H_2$ | 100 SCCM | | |
| | $SiH_4$ | 10 SCCM | | |

As a result of examining electrophotographic characteristics on the resultant photosensitive member using an experimental electrophotographic copying machine, it exhibited a high charge-retentivity and an excellent sensitivity.

Further, as a result of conducting image making tests by subjecting it to negative charge, image exposure and toner development using the above copying machine, a high quality toner image could be repeatedly obtained.

Independently, there was formed a plurality of carbonic sample films on Si-wafer substrates under the above-mentioned conditions for forming the carrier transportation layer. The resultant samples were engaged in chemical composition analysis and physical properties analysis.

As a result of measuring in accordance with Raman spectroscopy, it could be estimated that the carrier transportation layer possesses a clear Stokes line in the region containing 1333 $cm^{-1}$. And, as a result of measuring a IR absorption spectrum, it could be estimated that there was not absorption of C-H conbination. Further, as a result of measuring a electric conductivity, it could be estimated that the electric conductivity of the carrier transportation layer is $10^{-11}\Omega^{-1}cm^{-1}$.

More further, as a result of measuring with TEM, it could be estimated that the volume ratio of a graphite phase is about 1%.

COMPARATIVE EXAMPLE 5

The procedures of Example 44 were repeated, except that the gas flow rates for forming the carrier transportation layer were changed as shown in Table 3, to thereby an electrophotographic photosensitive member.

TABLE 3

| | |
|---|---|
| $H_2$ gas | 100 SCCM |
| $CH_4$ gas | 10 SCCM |

As a result of examining electrophotographic characteristics in the same way as in Example 44, it exhibited a low charge-retentivity and there could not obtained a satisfactory toner image.

Independently, there was formed a plurality of carbonic sample films on a Si-wafer substrates under the above-mentioned conditions for forming the carrier transportation layer. The resultant samples were engaged in chemical composition analysis and physical property analysis.

As a result of measuring in accordance with Raman spectroscopy, it could be estimated that the resultant carrier transportation layer has broad peaks in the regions containing 1580 $cm^{-1}$ and $1360^{-1}$ respectively. And, there was observed absorption in the region from 2900 $cm^{-1}$ to 3100 $cm^2$ under IR absorption spectrum.

Further, as a result of measuring an electric conductivity, it could be estimated that the electric conductivity of the carrier transportation layer is $10^{-6}\Omega^{-1}cm^{-1}$. More further, as a result of measuring with TEM, it could be estimated that the volume ratio of a graphite phase is 21%.

EXAMPLE 45

The procedures of Example 44 were repeated, except that the flow rates of raw material gases to be used were changed as shown in Table 4, to thereby an objective electrophotographic photosensitive member.

TABLE 4

| | |
|---|---|
| $H_2$ gas | 200 SCCM |
| $CH_4$ gas | 10 SCCM |
| $BH_3/H_2$ (1%, 99%) | 1 SCCM |

As a result of examining electrophotographic characteristics on the resultant photosensitive member using an experimental electrophotographic copying machine, it exhibited a high charge-retentivity and an excellent sensitivity. Further, as a result of conducting negative charge, image exposure, toner development and blade cleaning, there was obtained an excellent toner image, and it was found the photosensitive member excels in the cleaning property.

Independently, there was formed a plurality of carbonic sample films on Si-wafer substrates under the above-mentioned conditions for forming the carrier transportation layer. The resultant samples were engaged in chemical composition analysis and physical property analysis.

As a result, it could be estimated that the foregoing carrier transportation layer contains hydrogen atom in a concentration of 10 atomic % and it possesses an electric conductivity of $5\times10^{-11}\Omega^{-1}cm^{-1}$. Further, it could be estimated that there is present a weak and broad peak in each of the regions of 1360 $cm^{-1}$ and of 1580 $cm^{-1}$ in the foregoing carrier transportation layer and in addition, the volume ratio of a graphite phase therein is 6%.

EXAMPLE 46

The procedures of Example 44 were repeated, except that the gas flow rates for forming the carrier transportation layer were changed as shown in Table 5, to thereby an electrophotographic photosensitive member.

TABLE 5

| | |
|---|---|
| $H_2$ gas | 200 SCCM |
| $CH_4$ gas | 10 SCCM |
| $NH_3$ | 0.5 SCCM |

As a result of examining electrophotographic characteristics on the resultant photosensitive member using an experimental electrophotographic copying machine, it exhibited a high charge-retentivity and an excellent sensitivity.

Further, as a result of conducting image making tests by subjecting it to negative charge, image exposure and toner development using the above copying machine, a high quality toner image could be repeatedly obtained.

Independently, there was formed a plurality of carbonic sample films on Si-wafer substrates under the above-mentioned conditions for forming the carrier transportation layer. The resultant samples were engaged in chemical composition analysis and physical property analysis.

As a result, it could be estimated that the foregoing carrier transportation layer contains hydrogen atom in a concentration of 6 atomic % and it possesses an electric conductivity of $5\times10^{-11}\Omega^{-1}cm^{-1}$. Further, it could be estimated that there is present a weak and broad peak in each of the regions of 1360 $cm^{-1}$ and of 1580 $cm^{-1}$ under Raman spectroscopy in the foregoing carrier transportation layer and in addition, the volume ratio of a graphite phase therein is 5%.

EXAMPLE 47

The procedures of Example 44 were repeated, except that the gas flow rates for forming the carrier transportation layer were changed as shown in Table 6, to thereby an electrophotographic photosensitive member.

TABLE 6

| | |
|---|---|
| $H_2$ gas | 200 SCCM |
| $CH_4$ gas | 10 SCCM |
| $SiH_4$ gas | 0.5 SCCM |

As a result of examining electrophotographic characteristics on the resultant photosensitive member using an experimental electrophotographic copying machine, it exhibited a high charge-retentivity and an excellent sensitivity.

Further, as a result of conducting image making tests by subjecting it to negative charge, image exposure and toner development using the above copying machine, a high quality toner image could be repeatedly obtained.

Independently, there was formed a plurality of carbonic sample films on Si-wafer substrates under the above-mentioned conditions for forming the carrier transportation layer. The resultant samples were engaged in chemical composition analysis and physical property analysis.

As a result, it could be estimated that the foregoing carrier transportation layer contains hydrogen atom in a concentration of 11 atomic % and it possesses an electric conductivity of $1\times10^{-11}\Omega^{-1}cm^{-1}$. Further, it could be estimated that there is present a weak and broad peak in each of the regions of 1360 $cm^{-1}$ and of 1580 $cm^{-1}$ under Raman spectroscopy in the foregoing carrier transportation layer and in addition, the volume ratio of a graphite phase therein is 10%.

EXAMPLE 48

The procedures of Example 44 were repeated, except that the foow rates of raw material gases to be used were changed as shown in Table 7, to thereby an objective electrophotographic photosensitive member.

TABLE 7

| Layer & Thickness | Gas used & Flow rate | | Film forming conditions | |
|---|---|---|---|---|
| Carrier transportation layer (10 μm) | $H_2$ | 200 SCCM | inner pressure | $1\times10^{-3}$ Torr |
| | $CH_4$ | 5 SCCM | magnetic field | 875 Gauss |
| | | | substrate temperature | 300° C. |
| | | | substrate bias | −100 V |
| | | | microwave power | 300 W |
| Carrier generation layer (1 μm) | $H_2$ | 50 SCCM | inner pressure | $5\times10^{-4}$ Torr |
| | $SiH_4$ | 20 SCCM | substrate temperature | 200° C. |
| | | | Others are the same as the above | |
| Surface layer (0.1 μm) | $H_2$ | 100 SCCM | The same as in case of carrier transportation layer | |
| | $CH_4$ | 10 SCCM | | |
| | $SiH_4/H_2$ | 5 SCCM | | |

As a result of examining electrophotographic characteristics on the resultant photosensitive member using an experimental electrophotographic copying machine, it exhibited a high charge-retentivity and an excellent sensitivity.

Further, as a result of conducting image making tests by subjecting it to negative charge, image exposure and toner development using the above copying machine, a high quality toner image could be repeatedly obtained.

Independently, there was formed a plurality of carbonic sample films on Si-wafer substrates under the above-mentioned conditions for forming the carrier transportation layer. The resultant samples were engaged in chemical composition analysis and physical property analysis.

As a result, it could be estimated that the foregoing carrier transportation layer contains hydrogen atom in a concentration of 15 atomic % and it possesses an electric conductivity of $1\times10^{-13}\Omega^{-1}cm^{-1}$. Further, it could be estimated that there is present a sharp peak only in the region of 1333 $cm^{-1}$ under Raman spectroscopy in the foregoing carrier transportation layer and in addition, the volume ratio of a graphite phase therein is 2%.

What is claimed is:

1. A photosensitive member for use in electrophotography comprising a substrate and a divided-functional light receiving layer having a charge carrier transportation layer and a change carrier generation layer in this order from the side of said substrate, wherein said charge carrier transportation layer has a thickness of 1 to 100 μm and comprises a film containing (i) carbon atoms in an amount of at least 65 atomic percent, (ii) hydrogen atoms in an amount 30 atomic percent or less and (iii) at least one element selected from the group consisting of boron, aluminum, gallium, indium, thallium, nitrogen, phosphorus, arsenic, antimony and bismuth in an amount of 5 atomic ppm to 5 atomic percent; the matrix of said film being said carbon atoms; said film having a value of 0.18 to 5.9 for the ratio of $I_D/I_G$ between the peak intensity ($I_D$) of 1333 $cm^{-1}$ and the peak intensity ($I_G$) of 1850 $cm^{-1}$ in Raman spectra; and wherein said film contains a diamond phase in volume ratio of 50 to 90 percent, a graphite phase in a volume ratio of 20 percent or less and an amorphous carbon phase for the balance.

2. A photosensitive member for use in electrophotography according to claim 1, wherein said value for the ratio of $I_D/I_G$ is in the range of from 1.8 to 5.9.

3. A photosensitive member for use in electrophotography according to claim 1, wherein said film possesses an electric conductivity of $10^{-11}\Omega^{-1}cm^{-1}$ or less and an optical band gap of 1.5 eV or more.

4. A photosensitive member for use in electrophotography according to claim 3, wherein said film further possesses a gap state density of $5\times10^{17}$ $cm^{-3}$ or less.

5. A photosensitive member for use in electrophotography according to claim 1, wherein said film further contains fluorine atoms in an amount of 15 atomic % or less.

6. A photosensitive member for use in electrophotography according to claim 1, wherein said film further contains at least one kind selected from the group consisting of nitrogen atoms and oxygen atoms.

7. A photosensitive member for use in electrophotography according to claim 1, wherein the charge carrier transportation layer possesses a light absorption coefficient of $10^4cm^{-1}$ or less against light having an energy of 2.5 eV or less.

8. A photosensitive member for use in electrophotography according to claim 1, wherein the divided-functional light receiving layer additionally has a surface layer on the charge carrier generation layer.

9. A photosensitive member for use in electrophotography according to claim 8, wherein said surface layer comprises a film having a matrix of carbon atoms and an optical band gap of 2.0 eV or more.

10. A photosensitive member for use in electrophotography comprising a substrate ad a light receiving layer having a charge carrier generation layer and a charge carrier transportation layer in this order from the side of said substrate, wherein said charge carrier transportation layer has a thickness of 1 to 100 μm and comprises a film containing (i) carbon atoms in an amount of at least 65 atomic percent, (ii) hydrogen atoms in an amount of 30 atomic percent or less and (iii) at least one element selected from the group consisting of boron, aluminum, gallium, thallium, nitrogen, phosphorous, arsenic, antimony and bismuth in an amount of 5 atomic ppm to 5 atomic percent; the matrix of said film being said carbon atoms; said film having (iv) a value of 0.18 to 5.9 for the ratio of $I_D/I_G$ between the peak intensity ($I_D$) of 1333 $cm^{-1}$ and the peak intensity ($I_G$) of 1580 $cm^{-1}$ in Raman spectra and possessing (v) a coefficient of kinetic friction of 0.5 or less, and wherein said film contains a diamond phase in a volume ratio to 50 to 90 percent; a graphite phase in a volume ratio of 20 percent or less and an amorphous carbon phase for the balance.

11. A photosensitive member for use in electrophotography according to claim 10, wherein said value for the ratio of $I_D/I_G$ is in the range of from 1.8 to 5.9.

12. A photosensitive member for use in electrophotography according to claim 10, wherein said film possesses an electric conductivity of $10^{11}\Omega cm^{-1}$ or less and an optical band gap of 1.5 eV or more.

13. A photosensitive member for use in electrophotography according to claim 12, wherein said film further possesses a gap state density of $5\times10^{17}cm^{-3}$ or less.

14. A photosensitive member for use in electrophotography according to claim 10, wherein said film further contains fluorine atoms in an amount of 15 atomic % or less.

15. A photosensitive member for use in electrophotography according to claim 10, wherein said film further contains at least one kind selected from the group consisting of nitrogen atoms and oxygen atoms.

16. A photosensitive member for use in electrophotography according to claim 10, wherein the charge carrier transportation layer possesses a light absorption coefficient of $10^4cm^{-1}$ or less against light having an energy of 2.5 eV or less.

17. A photosensitive member for use in electrophotography according to claim 10, wherein the divided-functional light receiving layer additionally has a charge injection inhibition layer between the substrate and the charge carrier generation layer.

18. An electrophotographic process comprising:

(a) charging the photosensitive member of claim 1; and (b) irrdiating said photosensitive member with an electromagnetic wave carrying information, thereby forming an electrostatic image.

19. An electrophotographic process comprising:

(a) charging the photosensitive member of claim 10; and (b) irradiating said photosensitive member with an electromagnetic wave carrying information, thereby forming an electromagnetic image.

* * * * *

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 1

Line 17, "environment" should read --environmental--.
Line 62, "to cause" should read --producing--.

COLUMN 2

Line 19, "a" should be deleted.
Line 38, "against" should read --to--.
Line 55, "repeating" should read --repeated--.

COLUMN 3

Line 7, "th" should read --the--.
Line 60, "for and" should read --for man even upon touching and--.

COLUMN 4

Line 31, "complished" should read --accomplished--.
Line 45, "said carbonic" should read --said carbonic film--.
Line 49, "becomes to be" should read --is--.

COLUMN 5

Line 48, "nor" should read --or--.
Line 60, "further" should read --further it--.

COLUMN 6

Line 3, "further" should read --further it--.
Line 34, "does" should be deleted.
Line 35, "does" should be deleted.

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 7

Line 23, "friction In" should read --friction. In--.
Line 25, "extraporation." should read --extrapolation--.
Line 45, "were" should read --was--.
Line 51, "which" should be deleted.
Line 65, "gapstate" should read --gap state--.

COLUMN 8

Line 5, "yet" should be deleted.
Line 48, "be" should read --is--.
Line 49, "be" should read --is--.

COLUMN 9

Line 20, 2000 $cm^1$." should read --2000 $cm^{-1}$.--.
Line 44, "yet" should read --not yet--.
Line 49, "accelating" should read --accelerating--.
Line 50, "accelating" should read --accelerating--.

COLUMN 10

Line 9, "accelated" should read --accelerated--.
Line 21, "for" should read --to--.
Line 22, "ultraviolet of rays" should read --ultraviolet rays--.
Line 36, "for" should read --of--.
Line 45, "particualrly" should read --particularly-- and "view points" should read --viewpoints--.

COLUMN 11

Line 53, "23" should read --24--.

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 12

Line 2, "in" (second occurrence) should read --at--.
Line 21, "is" should read --is detected in the region of 1333 $cm^{-1}$. Depending--.
Line 22, Line 22 should be deleted.
Line 23, "of" (second occurrence) should be deleted.
Line 39, "know" should read --known--.
Line 57, "rather low" should read --rather lower--.
Line 68, "used" should be deleted.

COLUMN 14

Line 29, "sheet" should read --sheets--.

COLUMN 15

Line 13, "injection inhibition layer 11" should read --injection inhibition layer 21--.
Line 16, "11" should read --21--.
Line 20, "layer 11" should read --layer 21--.
Line 22, "A(" should read --Al--.
Line 26, "layer 11" should read --layer 21--.
Line 40, "accelating" should read --accelerating--.
Line 41, "accelating" should read --accelerating--.
Line 49, "yet" should read --not yet--.
Line 59, "to" should read --to form--.
Line 60, "to generate" should be deleted.
Line 63, "surved" should read --used--.
Line 65, "vias voltage" should read --bias voltage--.
Line 68, "accelate" should read --accelerate--.

UNITED STATES PATENT AND TRADEMARK OFFICE

CERTIFICATE OF CORRECTION

PATENT NO. :4,898,798

DATED :February 6, 1990

INVENTOR(S) :MASAO SUGATA, ET AL.

It is certified that error appears in the above-identified patent and that said Letters Patent is hereby corrected as shown below:

COLUMN 16

Line 7, "outobias" should read --autobias--.
Line 36, "condition" should read --conditions--.

COLUMN 17

Line 4, "become taking" should read --take--.
Lines 10-11, "become taking" should read --take--.
Line 14, "on what are" should read --to what is--.
Line 16, "under" should read --below--.
Line 28, "naphthalin," should read --naphthalene,--.
Line 36, "methlamine," should read --methylamine,--.

COLUMN 18

Line 31, "tun-" should read --tungsten,--.
Line 32, "gusten," should be deleted.

COLUMN 19

Line 5, "another" should read --other--.
Line 15, "deposition" should read --deposition chamber--.
Line 21, "hardly absorptive" should read --transmissive--.
Line 22, "place" should read --plate--.
Line 24, "402" should read --404--.
Line 54, "servoirs" should read --reservoirs-- and "vaporizer," should read --vaporizer 416,--.
Line 62, "serves" should read --serve--.

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 20

Line 43, "2 X $10^{31}$ $^{7}$Torr." should read --2 X $10^{-7}$Torr.--.
Line 50, "be-" should be deleted.
Line 51, "comes" should read --came--.

COLUMN 21

Line 24, "314 and 313" should read --314b and 313b--.
Line 31, "valve" should read --valves--.
Line 38, "continueously" should read --continuously--.

COLUMN 22

Line 10, "condition employed; should read --conditions employed:--.
Line 23, "im" should read --in--.
Line 38, "infrated" should read --infrared--.

COLUMN 23

Line 16, "coping" should read --copying--.
Line 51, "condition" should read --conditions--.

COLUMN 24

Line 46, "At" should read --As--.

COLUMN 25

Line 30, "there was made so as" should read --sufficient--.
Line 46, "switch" should read --switched--.
Line 47, "maintained" should be deleted.

UNITED STATES PATENT AND TRADEMARK OFFICE

CERTIFICATE OF CORRECTION

PATENT NO. :4,898,798

DATED :February 6, 1990

INVENTOR(S) :MASAO SUGATA, ET AL.

It is certified that error appears in the above-identified patent and that said Letters Patent is hereby corrected as shown below:

COLUMN 26

Line 10, "translation" should read --transportation--.
Line 22, "gas fed" should read --gas was fed--.
Line 34, "As results" should read --As a result-- and "a" should be deleted.
Line 57, "RP power" should read --RF power--.

COLUMN 27

Line 35, "obtained" should read --estimated--.
Line 43, "alteration" should read --alternation--.
Line 61, "coping" should read --copying--.
Lines 62-63, "was practically problematic" should read --were practical problems--.
Line 67, "2.45 V its" should read --2.45 V, and its--.

COLUMN 28

Line 24, "forming carrier transportation layer" should read --forming of the carrier transportation layer--.
Line 30, "coping" should read --copying--.
Lines 31-32, "was practically problematic" should read --were practical problems--.

COLUMN 29

Line 3, "aceton" should read --acetone--.
Line 7, "as" should read --as follows;--.
Line 44, "procedure" should read --procedures--.

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 30

Line 15, "lay consistuted" should read --layer constituted--.

COLUMN 31

Line 2, "be-" should be deleted.
Line 3, "comes" should read --came-- and "450° C. measured" should read --450° C. [measured--.
Line 38, "alteration" should read --alternation--.
Line 42, "313a and 313c" should read --315a and 315c--.
Line 51, "valve" should read --valves--.
Line 58, "continueously" should read --continuously--.
Line 67, "coping" should read --copying--.

COLUMN 32

Line 6, "coping" should read --copying--.
Line 10, "transport" should read --transportation--.
Line 12, "spectram" should read --spectrum--.
Line 56, "transportation" should read --transportation layer--.
Line 59, "infrated" should read --infrared--.

COLUMN 34

Line 9, "RF power bias" should read --RF power--.
Line 55, "10 SDCM" should read --10 SCCM--.
Line 65, "aceton" should read --acetone--.

UNITED STATES PATENT AND TRADEMARK OFFICE

CERTIFICATE OF CORRECTION

PATENT NO. 4,898,798

DATED February 6, 1990

INVENTOR(S) MASAO SUGATA, ET AL.

It is certified that error appears in the above-identified patent and that said Letters Patent is hereby corrected as shown below:

COLUMN 35

Line 12, "carrier transportation" should read --carrier transportation layer--.
Line 35, "there was made to" should read --sufficient to--.
Line 57, "A-S:H" should read --A-Si:H--.
Line 60, "408" should read --407--.
Line 61, "switch" should read --switched--.

COLUMN 36

Line 40, "tonner" should read --toner--.

COLUMN 37

Line 14, "a" should read --as a--.
Line 27, "alteration" should read --alternation--.
Line 47, "there" should read --it--.

COLUMN 38

Line 1, "alteration" should read --alternation--.
Line 3, "forming carrier transportation layer" should read --forming of the carrier transportation layer--.
Line 10, "there" should read --it--.
Line 42, "be-" should be deleted.
Line 43, "comes" should read --came-- and "measured" should read --[measured--.
Line 52, "alteration" should read --alternation--.

--

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 39

Line 9, "alteration" should read --alternation--.
Line 15, "314 and 313" should read --314b and 313b--.

COLUMN 40

Line 40, "changes" should read --changed--.

COLUMN 41

Line 2, "8 atomic" should read --8 atomic %--.
Line 62, "At" should read --As--.

COLUMN 42

Line 3, "aceton" should read --acetone--.
Line 49, "there was made so as" should read --sufficient--.
Line 64, "408" should read --407--.
Line 66, "The," should read --The-- and "switch" should read --switched--.

COLUMN 43

Line 22, "tonner" should read --toner--.

COLUMN 44

Line 23, "At" should read --As--.
Line 32, "aceton" should read --acetone--.
Line 60, "repeatdly" should read --repeatedly--.

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 45

Line 10, "chamger" should read --chamber--.
Line 18, "to be" should be deleted.
Line 19, "(not shown]." should read --(not shown)].--.
Line 26, "alteration" should read --alternation--.
Line 37, "reservoir 313" should read --reservoir 312--.
Line 53, "alteration" should read --alternation--.
Line 64, "A-SiH" should read --A-Si:H--.

COLUMN 46

Line 5, "continueously" should read --continuously--.

COLUMN 47

Line 7, "changes" should read --changed--.

COLUMN 48

Line 10, "201" should read --301--.
Line 26, "At" should read --As--.
Line 35, "aceton" should read --acetone--.

COLUMN 49

Line 15, "there was made so as" should read --sufficient--.
Line 30, "408" should read --407--.
Line 32, "switch" should read --switched--.
Line 38, "form" should read --was formed--.

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 50

Line 1, "changes" should read --changed--.
Line 45, "deposited thickness" should read --deposited in the thickness--.
Line 51, "At" should read --As--.
Line 55, "$H_2$" should read --$H_2$ gas--.
Line 59, "3 mol %" should read --3 mole %--.
Line 60, "aceton" should read --acetone--.

COLUMN 51

Line 51, "becomes to be" should read --became--.
Line 60, "alteration" should read --alternation--.

COLUMN 52

Line 5,"event, Torr." should read --event, the inner pressure of the film forming space was 2 X $10^{-3}$ Torr.--.
Line 7, "dischargingnder" should read --discharging under--.
Line 18, "alteration" should read --alternation--.
Line 29, "A-SiH for" should read --A-Si:H of--.
Line 31, "valve" should read --valves--.
Line 38, "contineously" should read --continuously--.
Line 60, "spectram" should read --spectrum--.

COLUMN 53

Line 5, "changes" should read --changed--.

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 54

Line 27, "changes" should read --changed--.

COLUMN 55

Line 5, "changes" should read --changed--.
Line 58, "410'" should read --410',--.
Line 60, "property." should read --properly.--.
Line 66, "irradiated" should read --were irradiated--.

COLUMN 56

Line 11, "408" should read --407--.
Line 51, "changes" should read --changed--.

COLUMN 57

Line 51, "At" should read --As--.
Line 59, "3 mol %" should read --3 mole %--.
Line 60, "aceton" should read --acetone--.

COLUMN 59

Line 1, "conbination" should read --combination--.
Line 22, "not obtained" should read --not be obtained--.
Line 25, "a" should be deleted.
Line 33, "$1360^{-1}$" should read --1360 $cm^{-1}$--.

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 61

Line 21, "foow rates" should read --flow rates--.

TABLE 7,

| | | | | |
|---|---|---|---|---|
| "Carrier transportation layer (10μm) | $H_2$ 5 SCCM $CH_4$ | 200 SCCM | inner pressure | 1 X $10^{-3}$Torr |
| | | magnetic field | 875 Gauss | |
| | | | substrate temperature | 300°C." |

should read

| | | | | |
|---|---|---|---|---|
| --Carrier transportation layer (10μm) | $H_2$ $CH_4$ | 200 SCCM 5 SCCM | inner pressure | 1 X $10^{-3}$Torr |
| | | | magnetic field | 875 Gauss |
| | | | substrate temperature | 300°C.--. |

COLUMN 62

Line 4, "amount" should read --amount of--.
Line 12, "1850 $cm^{-1}$" should read --1580 $cm^{-1}$--.
Line 66, "ad" should read --and--.

COLUMN 63

Line 17, "ratio to" should read --ratio of--.

UNITED STATES PATENT AND TRADEMARK OFFICE

CERTIFICATE OF CORRECTION

PATENT NO. : 4,898,798

DATED : February 6, 1990

INVENTOR(S) : MASAO SUGATA, ET AL.

It is certified that error appears in the above-identified patent and that said Letters Patent is hereby corrected as shown below:

COLUMN 64

Line 22, "irrdiating" should read --irradiating--.
Line 30, "electromagnetic image." should read --electrostatic image.--.

Signed and Sealed this

Eighteenth Day of August, 1992

*Attest:*

*Attesting Officer*

DOUGLAS B. COMER

*Acting Commissioner of Patents and Trademarks*